US010486442B2

(12) United States Patent
Sudo

(10) Patent No.: US 10,486,442 B2
(45) Date of Patent: Nov. 26, 2019

(54) PRINTING UNIT AND THERMAL PRINTER

(71) Applicant: Seiko Instruments Inc., Chiba-shi, Chiba (JP)

(72) Inventor: Shinichi Sudo, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/047,538

(22) Filed: Jul. 27, 2018

(65) Prior Publication Data

US 2019/0030923 A1 Jan. 31, 2019

(30) Foreign Application Priority Data

Jul. 31, 2017 (JP) ..... 2017-147873
Sep. 28, 2017 (JP) ..... 2017-189157

(51) Int. Cl.

| | |
|---|---|
| ***B26D 5/08*** | (2006.01) |
| ***B41J 11/70*** | (2006.01) |
| ***B41J 2/32*** | (2006.01) |
| ***B26D 1/08*** | (2006.01) |
| *B41J 11/66* | (2006.01) |
| *B26D 5/20* | (2006.01) |

(52) U.S. Cl.

CPC ..... *B41J 11/70* (2013.01); *B26D 1/085* (2013.01); *B26D 5/083* (2013.01); *B41J 2/32* (2013.01); *B26D 5/20* (2013.01); *B41J 11/66* (2013.01)

(58) Field of Classification Search

CPC .... B41J 11/70; B41J 2/32; B41J 11/66; B26D 1/085; B26D 5/083; B26D 5/20

See application file for complete search history.

(56) References Cited

U.S. PATENT DOCUMENTS

2006/0230956 A1 10/2006 Yoshioka
2011/0026999 A1* 2/2011 Kohira ..... B26D 1/085 400/621
2014/0056633 A1 2/2014 Tsuchiya et al.
2015/0002605 A1* 1/2015 Aizawa ..... B41J 15/042 347/222

FOREIGN PATENT DOCUMENTS

EP 1 095 782 A2 5/2001
EP 2 279 834 A2 2/2011
JP 2014040077 3/2014

OTHER PUBLICATIONS

Extended European Search Report dated Jan. 28, 2019 for European Application No. 18186057.8, 6 pages.

* cited by examiner

*Primary Examiner* — Yaovi M Ameh
(74) *Attorney, Agent, or Firm* — Brinks Gilson & Lione

(57) ABSTRACT

A printing unit includes a frame, a head unit including a thermal head, a platen unit including a platen roller, a fixed blade provided to any one of the head unit and the platen unit, a movable blade provided to another one of the head unit and the platen unit and configured to slide with respect to the fixed blade, a drive mechanism configured to cause the movable blade to slide between a standby position of being separated from the fixed blade and a cutting position of riding on the fixed blade, an lever configured to release locking of the platen unit with respect to the head unit, and a return mechanism configured to move the movable blade to the standby position before releasing the locking of the platen unit by being interlocked with the lever under a state in which the movable blade is held at the cutting position.

9 Claims, 16 Drawing Sheets

PRINTING UNIT AND THERMAL PRINTER

RELATED APPLICATIONS

This application claims priority under 35 U.S.C. § 119 to Japanese Patent Application Nos. 2017-147873 filed on Jul. 31, 2017 and 2017-189157 filed Sep. 28, 2017, the entire content of which are hereby incorporated by reference.

BACKGROUND OF THE INVENTION

1. Field of the Invention

The present invention relates to a printing unit and a thermal printer.

2. Description of the Related Art

A thermal printer, for example, is equipped with a printing unit. The printing unit is configured to cut paper with a movable blade and a fixed blade by moving the movable blade from a standby position to a cutting position. It is conceivable that, when the movable blade is moved to the cutting position, a paper jam occurs between the movable blade and the fixed blade, and the movable blade stops at a position of riding on the fixed blade. In this case, there has been known a configuration in which an operation lever is operated to open a gap between the movable blade and the fixed blade in order to eliminate the paper jam. The load of the paper jam is removed by forming a gap between the movable blade and the fixed blade. Through removal of the load of the paper jam, the movable blade can be returned to a home position (hereinafter referred to as "standby position") with a restoring force of a spring.

In the configuration in which a gap is formed between the fixed blade and the movable blade, when a paper jam larger than the gap occurs, it is difficult to completely remove the load of the paper jam. Therefore, even when a gap is formed between the fixed blade and the movable blade by one operation of the operation lever, there is a risk in that the movable blade may not be returned. In this case, it is required to eliminate the paper jam by repeatedly operating the operation lever, and hence it can be said that a capability in eliminating the paper jam is low.

Further, when the paper jam cannot be eliminated, a state in which the movable blade stops at a position of riding on the fixed blade cannot be cancelled. Thus, a cover of a printer having the fixed blade mounted thereon cannot be opened. That is, neither the fixed blade nor the movable blade can be exposed to an outside. Therefore, when a paper jam larger than a gap occurs, it is difficult to eliminate the paper jam, and hence there remains room for improvement from the above-mentioned viewpoint.

Therefore, the printing unit and the thermal printer of the above-mentioned type have been required to be capable of easily eliminating a paper jam.

SUMMARY OF THE INVENTION

According to one embodiment of the present invention, there is provided a printing unit, including: a head unit including a thermal head configured to perform printing on a recording sheet; a platen unit including a platen roller configured to convey the recording sheet and is separably combined with the head unit; a fixed blade provided to any one of the head unit and the platen unit; a movable blade, which is to be provided to another one of the head unit and the platen unit, and is configured to slide with respect to the fixed blade; a drive mechanism configured to cause the movable blade to slide between a standby position of being separated from the fixed blade and a cutting position of riding on the fixed blade; an unlocking lever configured to release locking of the platen unit with respect to the head unit; and a return mechanism configured to move the movable blade to the standby position before releasing the locking of the platen unit by being interlocked with the unlocking lever under a state in which the movable blade is held at the cutting position.

In the above-mentioned printing unit according to the one embodiment of the present invention, wherein the return mechanism includes a return rack formed on a drive rack of the drive mechanism, and a return pinion configured to mesh with rack teeth of the return rack so as to be interlocked with the unlocking lever.

In the above-mentioned printing unit according to the one embodiment of the present invention, wherein the return rack includes rack teeth, which are formed on a side opposite to a blade edge of the movable blade so that the rack teeth are meshed with the return pinion under a state in which the return rack is arranged at the cutting position and so that the meshing of the rack teeth with respect to the return pinion is released under a state in which the return rack is arranged at the standby position.

In the above-mentioned printing unit according to the one embodiment of the present invention, wherein the return pinion is rotatably provided to a support shaft of a drive pinion of the drive mechanism, the support shaft being configured to mesh with the drive rack.

In the above-mentioned printing unit according to the one embodiment of the present invention, wherein one tooth of the pinion teeth is removed from the return pinion.

According to one embodiment of the present invention, there is provided a thermal printer, including the above-mentioned printing unit, wherein the movable blade is provided to a printer main body including a recording-sheet receiving portion configured to receive the recording sheet, and wherein the fixed blade is provided to a printer cover, which is pivotably coupled to the printer main body, and is configured to open and close the recording-sheet receiving portion.

DETAILED DESCRIPTION OF THE PREFERRED EMBODIMENTS

Now, first embodiment of the present invention is described with reference to the drawings.

Figure 1:
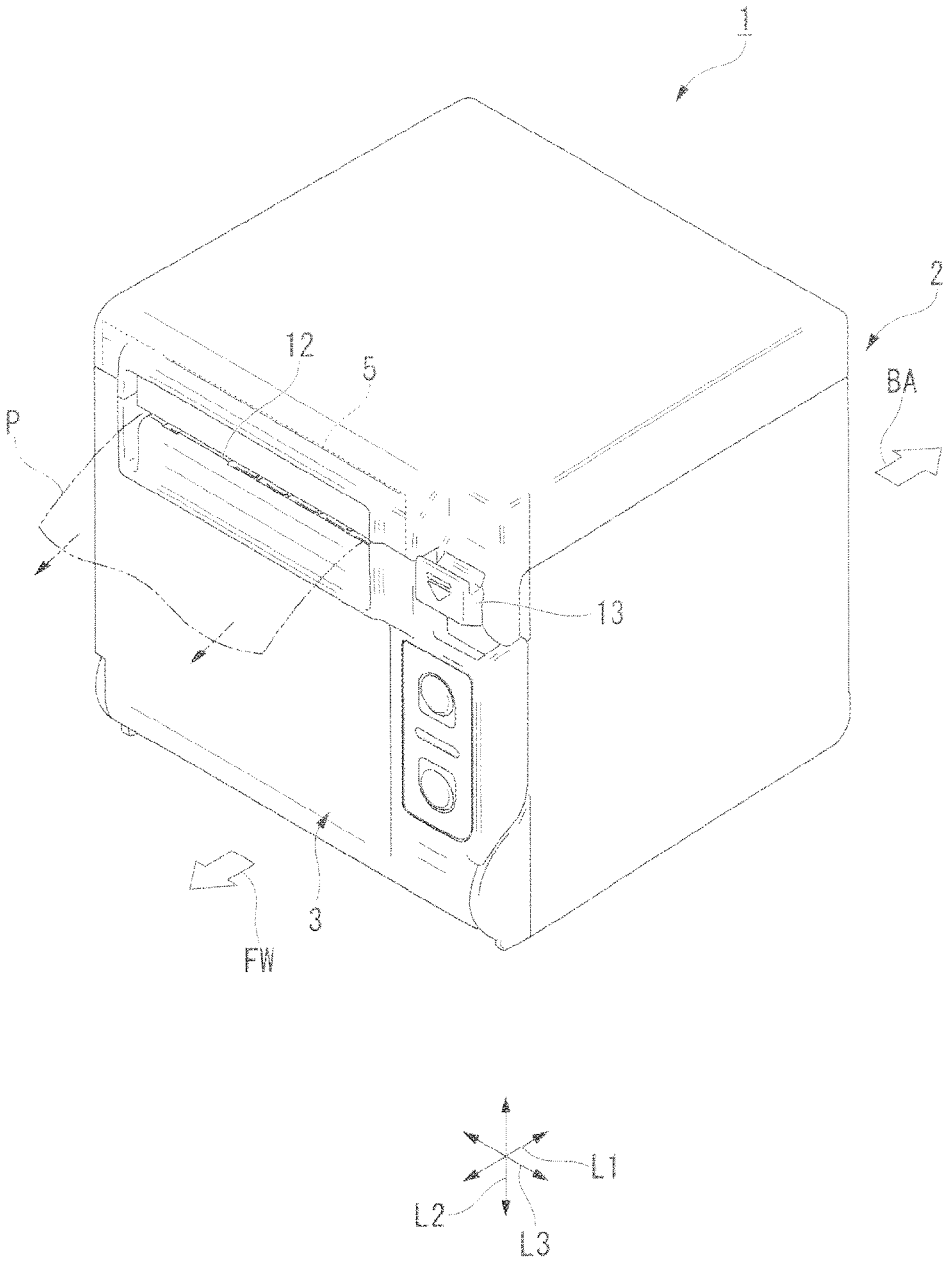
FIG. 1 is a perspective view for illustrating a state in which a printer cover of a thermal printer according to first embodiment of the present invention is closed to a closed position.
Figure 2:
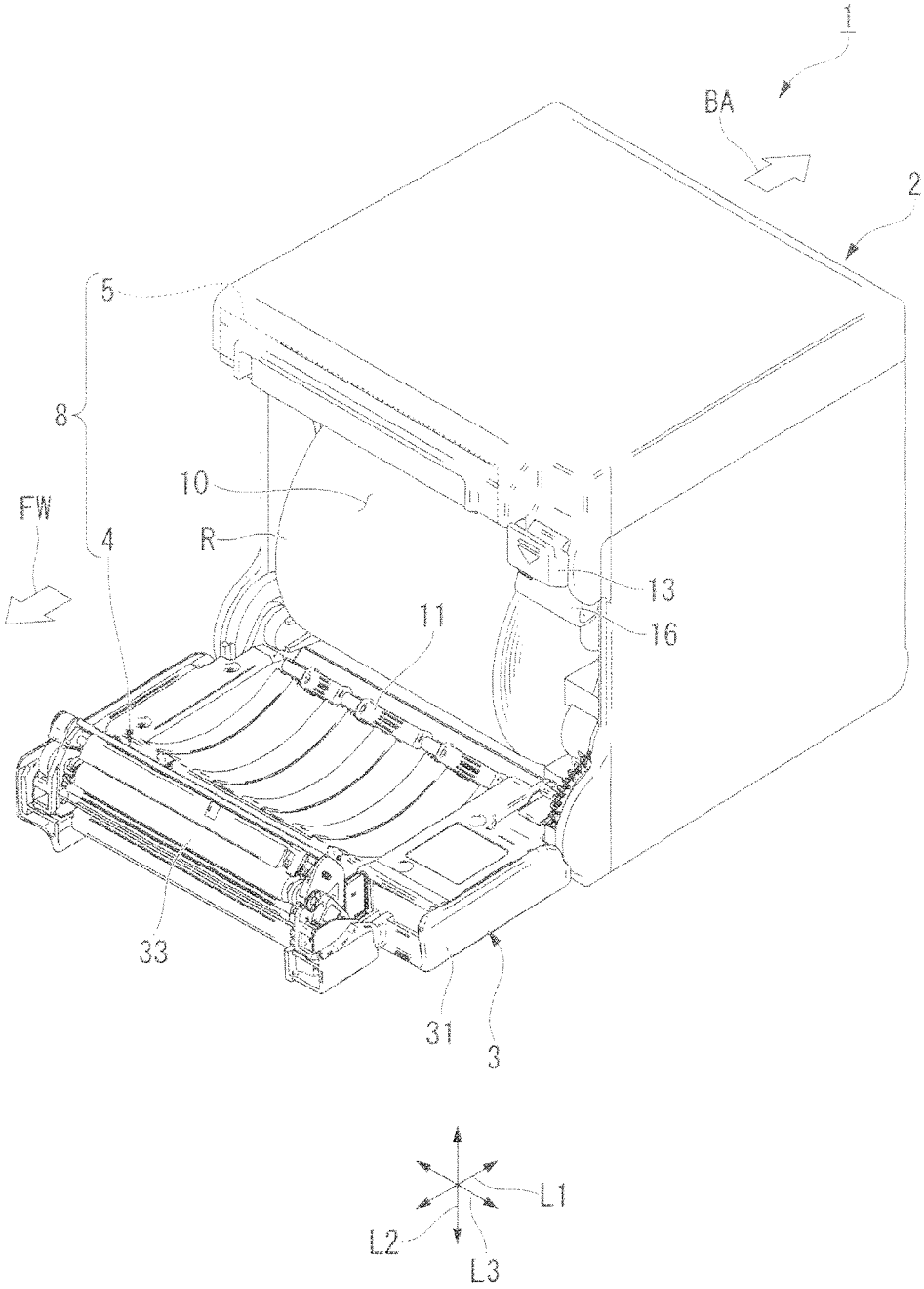
FIG. 2 is a perspective view for illustrating a state in which the printer cover of the thermal printer according to the first embodiment of the present invention is opened to an open position.

FIG. 1 is a perspective view for illustrating a thermal printer 1 having a printer cover 3 at a closed position. FIG. 2 is a perspective view for illustrating the thermal printer 1 having the printer cover 3 at an open position. As illustrated in FIG. 1 and FIG. 2, the thermal printer 1 is a printer configured to perform printing on a recording sheet P (heat-sensitive paper or paper) pulled out from a roll sheet R so that the recording sheet P can be used as a ticket, a receipt, or the like. The thermal printer 1 includes a casing (printer main body) 2, the printer cover 3, a platen unit 4 provided on the printer cover 3 side, and a head unit 5 provided on the casing 2 side. The platen unit 4 and the head unit 5 form a printing unit 8.

In this embodiment, at the closed position of the printer cover 3 illustrated in FIG. 1, a lower left side (printer cover 3 side) of a drawing sheet is defined as a forward side (direction of the arrow FW), an upper right side (casing 2 side) thereof is defined as a backward side (direction of the arrow BA), an upper side thereof is defined as an upward side, and a lower side thereof is defined as a downward side. Further, the recording sheet P is delivered to the forward side FW. A direction orthogonal to a fore-and-aft direction L1 and a vertical direction L2 is defined as a horizontal direction L3. Therefore, each direction may be reversed depending on each figure.

The casing 2 is formed into a cube shape opened to the forward side FW through use of a resin material, a metal material, or an appropriate combination thereof. The casing 2 includes a frame body serving as a basic skeleton, and an exterior cover for covering the frame body. A recording-sheet receiving portion 10 configured to receive the roll sheet R is formed in the casing 2, and the recording-sheet receiving portion 10 is opened by opening the printer cover 3. The recording-sheet receiving portion 10 has a box shape that is formed of a part of the above-mentioned frame body and is opened to the forward side FW. The recording-sheet receiving portion 10 is configured to receive the roll sheet R on an inner side thereof under a state in which a width direction of the roll sheet R is matched with the horizontal direction L3.

Further, a first pivot shaft 11 extending along the horizontal direction L3 is arranged in a lower portion of an opening edge of the casing 2. The printer cover 3 is coupled to the first pivot shaft 11 so as to be pivotable with respect to the casing 2. The printer cover 3 pivots within a range of an angle of about 90° between the closed position (position of FIG. 1) at which an opening portion of the casing 2 is closed and the open position (position of FIG. 2) at which the opening portion of the casing 2 is opened. With this, the opening portion of the casing 2 (that is, the recording-sheet receiving portion 10) is opened and closed by the printer cover 3. When the printer cover 3 is at the open position, the recording-sheet receiving portion 10 is opened, and for example, the roll sheet R can be loaded into the recording-sheet receiving portion 10 (so-called drop-in system).

Further, the thermal printer 1 has a configuration in which a slight gap is formed between a distal end portion of the printer cover 3 and the casing 2 at the closed position of the printer cover 3. The recording sheet P is pulled out from an inner portion of the casing 2 to the forward side FW through use of the gap. Thus, the slight gap serves as a delivery port 12 of the recording sheet P. The casing 2 and the printer cover 3 are locked with each other at the closed position under a state in which the platen unit 4 and the head unit 5 are combined with each other. Further, of corner portions positioned on an upper front side of the casing 2, the corner portion positioned on one side in the horizontal direction L3 is provided with an operation lever 13 configured to release the combination between the platen unit 4 and the head unit 5 to perform an opening operation of the printer cover 3.

Figure 3:
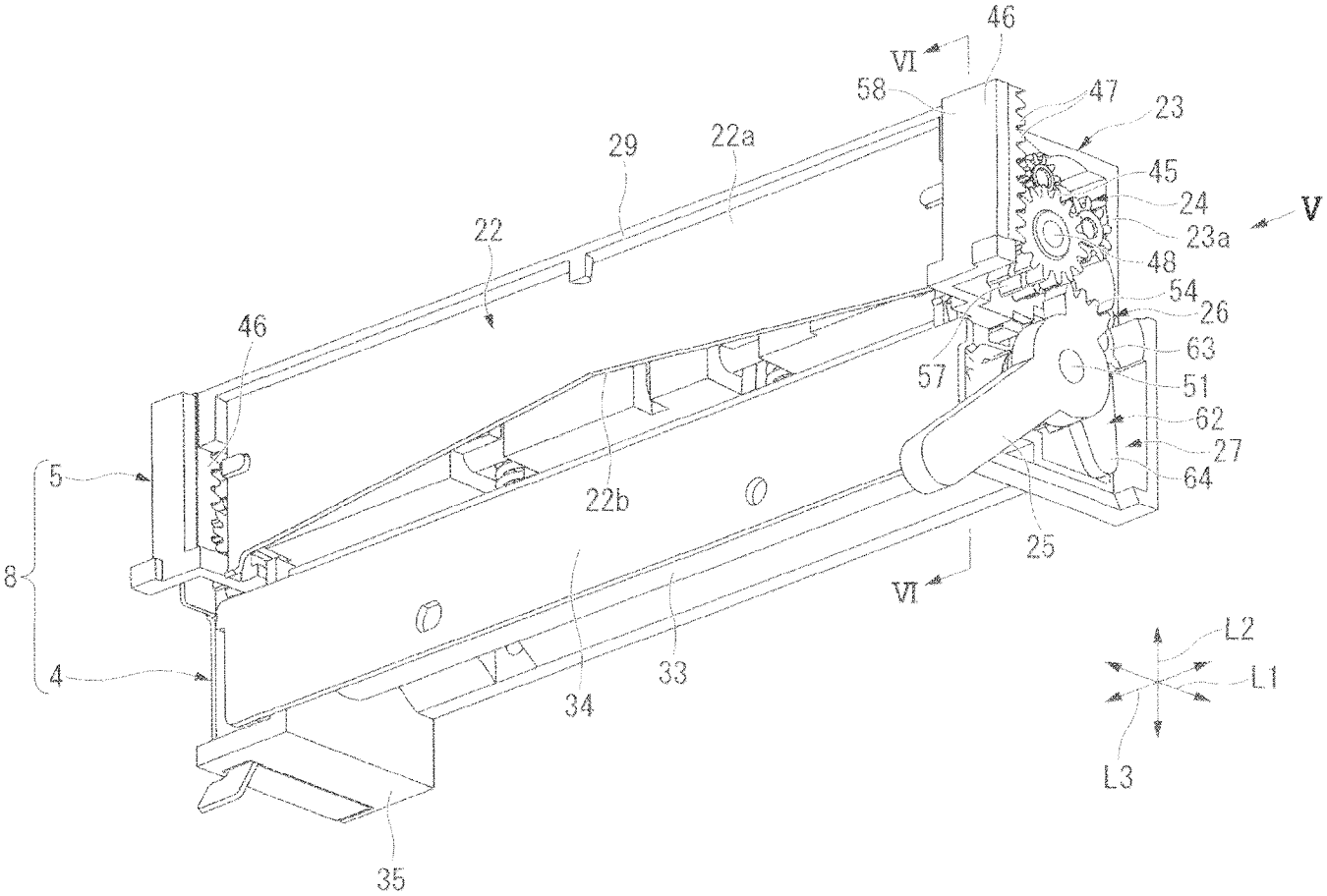
FIG. 3 is a perspective view of a printing unit of the thermal printer according to the first embodiment of the present invention when viewed from below.

FIG. 3 is a perspective view of the printing unit 8 when viewed from below. As illustrated in FIG. 2 and FIG. 3, the head unit 5 is a unit in which a thermal head (not shown) and a movable blade 22 are mainly incorporated, and is arranged on the upper front side inside the casing 2. The head unit 5 is fixed to an inner plate extending downward from an upper surface of the casing 2 and is held on the forward side FW with respect to the recording-sheet receiving portion 10.

The head unit 5 includes a head frame 23, the thermal head, the movable blade 22, a movable blade drive mechanism (drive mechanism) 24, an unlocking lever 25, a return mechanism 26, and an unlocking mechanism 27. The head frame 23 is, for example, a frame made of metal. The thermal head includes a plurality of heating elements arrayed in a line shape along the horizontal direction L3.

The platen unit 4 is mounted on an upper portion of an inner surface of the printer cover 3 at a position at which the platen unit 4 overlaps with a reinforcing member 31 in the fore-and-aft direction L1, and is separably combined with the head unit 5 along with an opening/closing operation of the printer cover 3. Specifically, the platen unit 4 includes a platen roller 33, a fixed blade 34, and a platen frame 35. The platen roller 33 is a roller configured to convey the recording sheet P to an outside of the printer cover 3. The fixed blade 34 is provided in the printer cover 3 and is arranged on the forward side FW with respect to the platen roller 33. The platen frame 35 is a frame configured to support the platen roller 33 and the fixed blade 34. Thus, the fixed blade 34 is provided on the printer cover 3. Therefore, it is not required to provide, on the printer cover 3, the movable blade drive mechanism 24 configured to drive the movable blade 22. With this, the printer cover 3 can be reduced in weight, and the operability for opening and closing the printer cover 3 can be satisfactorily ensured.

As illustrated in FIG. 1 and FIG. 2, in the printing unit 8 of the thermal printer 1, the thermal head of the head unit 5 is formed into a plate shape extending along the horizontal direction L3 (width direction of the recording sheet P). The thermal head includes the plurality of heating elements arrayed in a line shape along the horizontal direction L3. Printing is performed on the recording sheet P by the thermal head. Further, the thermal head is opposed to the platen roller 33 at the closed position of the printer cover 3 and is arranged so that the recording sheet P can pass through a region between the thermal head and the platen roller 33.

Further, a coil spring configured to bias the thermal head downwardly (to the platen roller 33 side) is interposed between the thermal head and the platen roller 33. With this, the thermal head can be reliably pressed against the recording sheet P sent out by the platen roller 33, and satisfactory printing can be performed by the printing unit 8.

Figure 4:
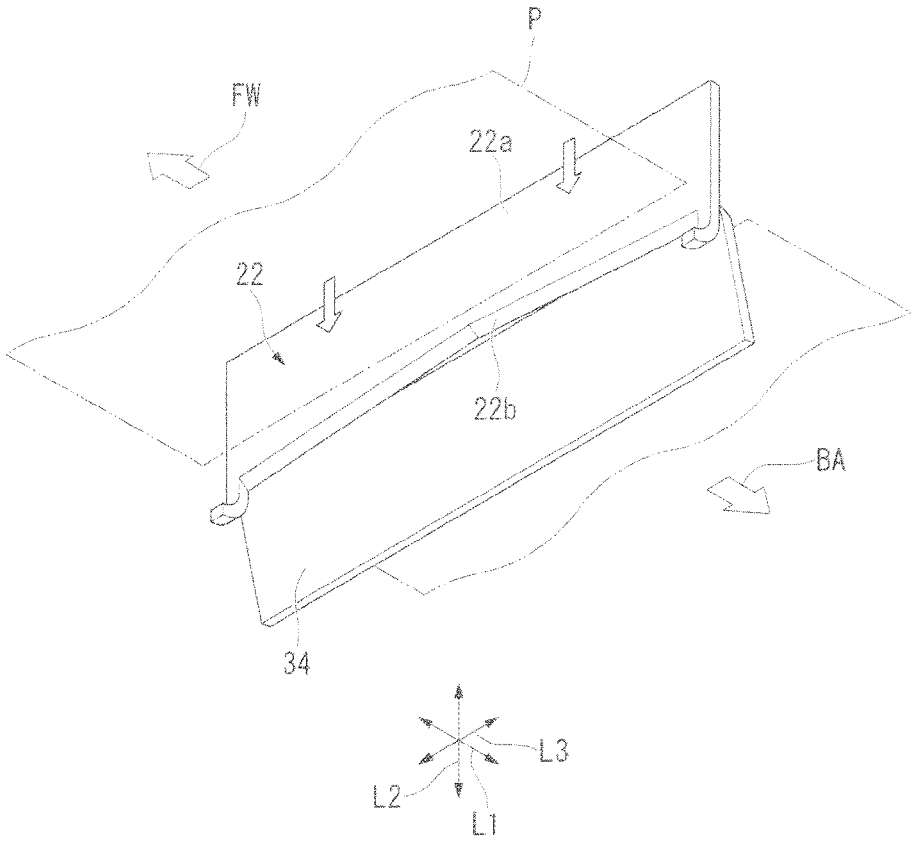
FIG. 4 is a perspective view for illustrating a state in which a recording sheet is cut between a movable blade and a fixed blade of the printing unit in the first embodiment of the present invention.

FIG. 4 is a view for illustrating a state in which the movable blade 22 is caused to slide to cut the recording sheet P between the fixed blade 34 and the movable blade 22. As illustrated in FIG. 3 and FIG. 4, the movable blade 22 is provided on the casing 2 (see FIG. 2) through intermediation of the movable blade drive mechanism 24. The movable blade 22 is arranged so as to be opposed to the fixed blade 34 in the fore-and-aft direction L1 at the closed position (see FIG. 1) of the printer cover 3 under a state in which the head unit 5 and the platen unit 4 are combined with each other. The movable blade 22 is a plate-like blade having a V shape formed so that a length from a root 22*a* to a blade edge 22*b* gradually becomes shorter from both ends to a center. Further, the movable blade 22 is mounted on drive racks 46 of the movable blade drive mechanism 24 through intermediation of a movable blade holder 29. The movable blade 22 is formed so as to be slidable in the vertical direction L2 with respect to the head frame 23 due to the operation of the movable blade drive mechanism 24. That is, the movable blade 22 is supported so as to be slidable with respect to the fixed blade 34.

Figure 5:
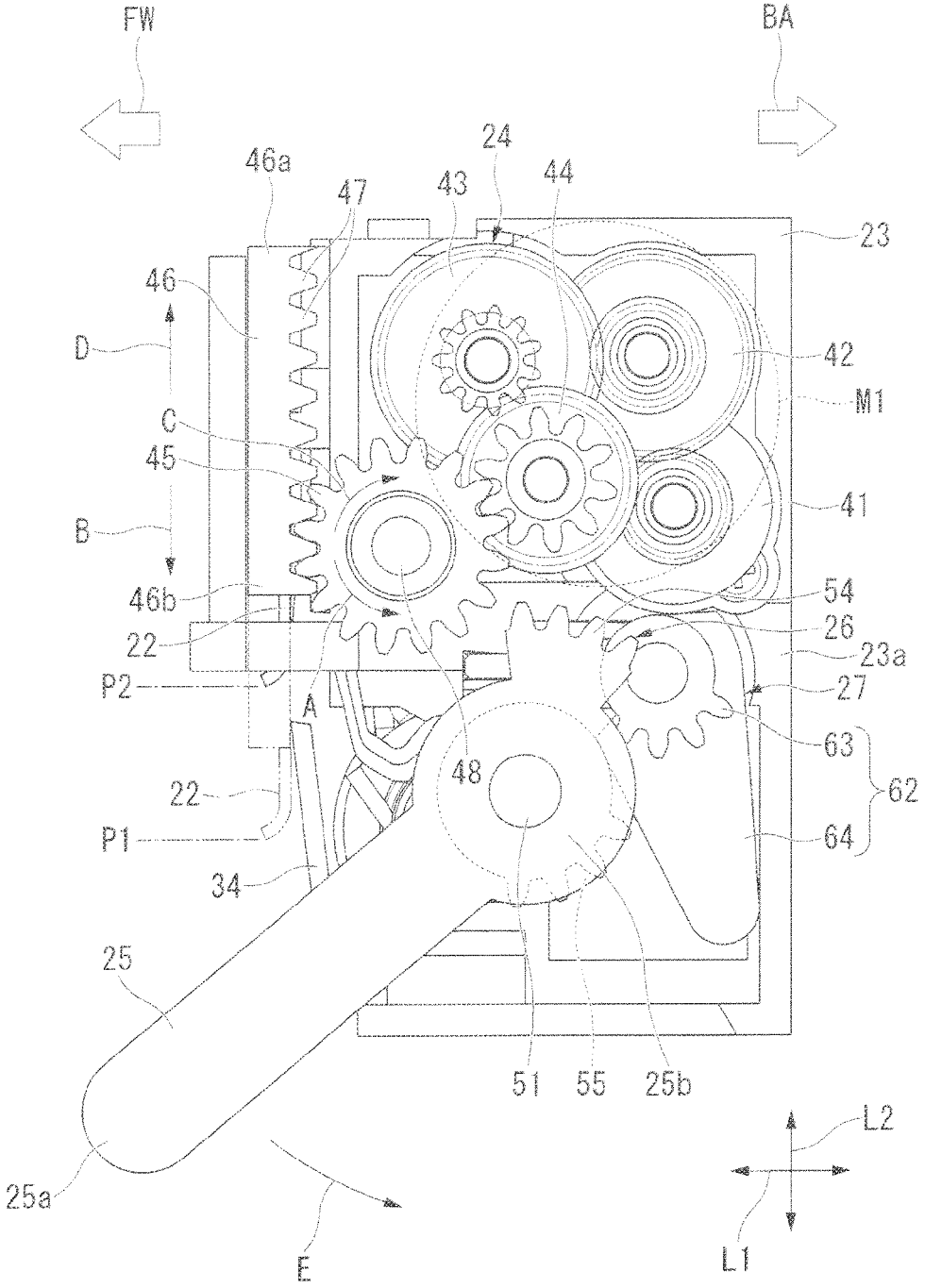
FIG. 5 is a side view for illustrating the printing unit in the first embodiment of the present invention when viewed from a direction of an arrow V of FIG. 3.

FIG. 5 is a view for illustrating the printing unit 8 when viewed from a direction of an arrow V of FIG. 3. As illustrated in FIG. 3 and FIG. 5, the movable blade drive mechanism 24 is a mechanism configured to move the movable blade 22 to a cutting position P1 and a standby position P2. The cutting position P1 is a position at which the movable blade 22 rides on the fixed blade 34 to cut the recording sheet P together with the fixed blade 34. The standby position P2 is a position at which the movable blade 22 is separated from the fixed blade 34. Specifically, the movable blade drive mechanism 24 includes a motor M1 for driving, first to fourth drive teeth 41 to 44, drive pinions 45, and the drive racks 46.

The motor M1 for driving is a motor capable of performing forward and reverse rotation. The first drive teeth 41 are coupled to a drive shaft of the motor M1 for driving. The first drive teeth 41 are coupled to the drive pinion 45 through intermediation of the second to fourth drive teeth 42 to 44. The drive pinion 45 is coaxially mounted on a pinion support shaft (support shaft) 48. The pinion support shaft 48 rotates integrally with the drive pinion 45. The drive pinions 45 are provided as a pair respectively on both sides in the horizontal direction L3. The pair of drive pinions 45 are meshed with the drive racks 46 provided respectively on both sides in the horizontal direction L3. The pair of drive pinions 45 are coupled to each other with the pinion support shaft 48.

Each of the drive racks 46 has a plurality of drive rack teeth 47 formed from an end portion (upper end portion) 46*a* on the standby position P2 side to an end portion (lower end portion) 46*b* on the cutting position P1 side. That is, the drive rack 46 has the drive rack teeth 47 formed in an entire region of the drive rack 46. The drive racks 46 are mounted in both end portions of the movable blade holder 29 along the horizontal direction L3 and extend along the vertical direction L2. That is, the movable blade 22 is mounted on the drive racks 46 through intermediation of the movable blade holder 29. Now, in order to facilitate understanding of the configuration, detailed description is given of the drive pinion 45 and the drive rack 46 on a side of the motor M1 for driving, and detailed description of the drive pinion 45 and the drive rack 46 on a side opposite to the motor M1 for driving is omitted.

When the motor M1 for driving rotates forwardly, the rotation of the motor M1 for driving is transmitted to the drive pinion 45 through the first to fourth drive teeth 41 to 44. The drive pinion 45 rotates in a direction of an arrow A, and the drive rack 46 moves in a direction of an arrow B together with a return rack 58 (described later) of the return mechanism 26. When the drive rack 46 moves, the movable blade 22 linearly moves in the direction of the arrow B together with the drive rack 46. That is, the movable blade 22 moves to the cutting position P1.

Meanwhile, when the motor M1 for driving rotates reversely, the rotation of the motor M1 for driving is transmitted to the drive pinion 45 through the first to fourth drive teeth 41 to 44. The drive pinion 45 rotates in a direction of an arrow C, and the drive rack 46 moves in a direction of an arrow D. When the drive rack 46 moves, the movable blade 22 linearly moves in the direction of the arrow D together with the drive rack 46. That is, the movable blade 22 moves to the standby position P2.

The unlocking lever 25 is pivotably supported by a side wall portion 23*a* of the head frame 23 through intermediation of a lever support shaft 51. Specifically, the unlocking lever 25 can perform a pushing operation backwardly. A distal end portion 25*a* of the unlocking lever 25 is fitted on an inner side of a coupling member 16 (see FIG. 2) of the operation lever 13. The unlocking lever 25 is operated by being interlocked with the pivoting operation of the operation lever 13 (see FIG. 2).

That is, when the operation lever 13 is pivoted from a lock position to a release position, the unlocking lever 25 is pivoted in a direction of an arrow E. A first gear 54 and a second gear 55 are formed on a proximal end portion 25*b* of the unlocking lever 25. The first gear 54 is a member forming a part of the return mechanism 26. The second gear 55 is a member forming a part of the unlocking mechanism 27.

Figure 6:
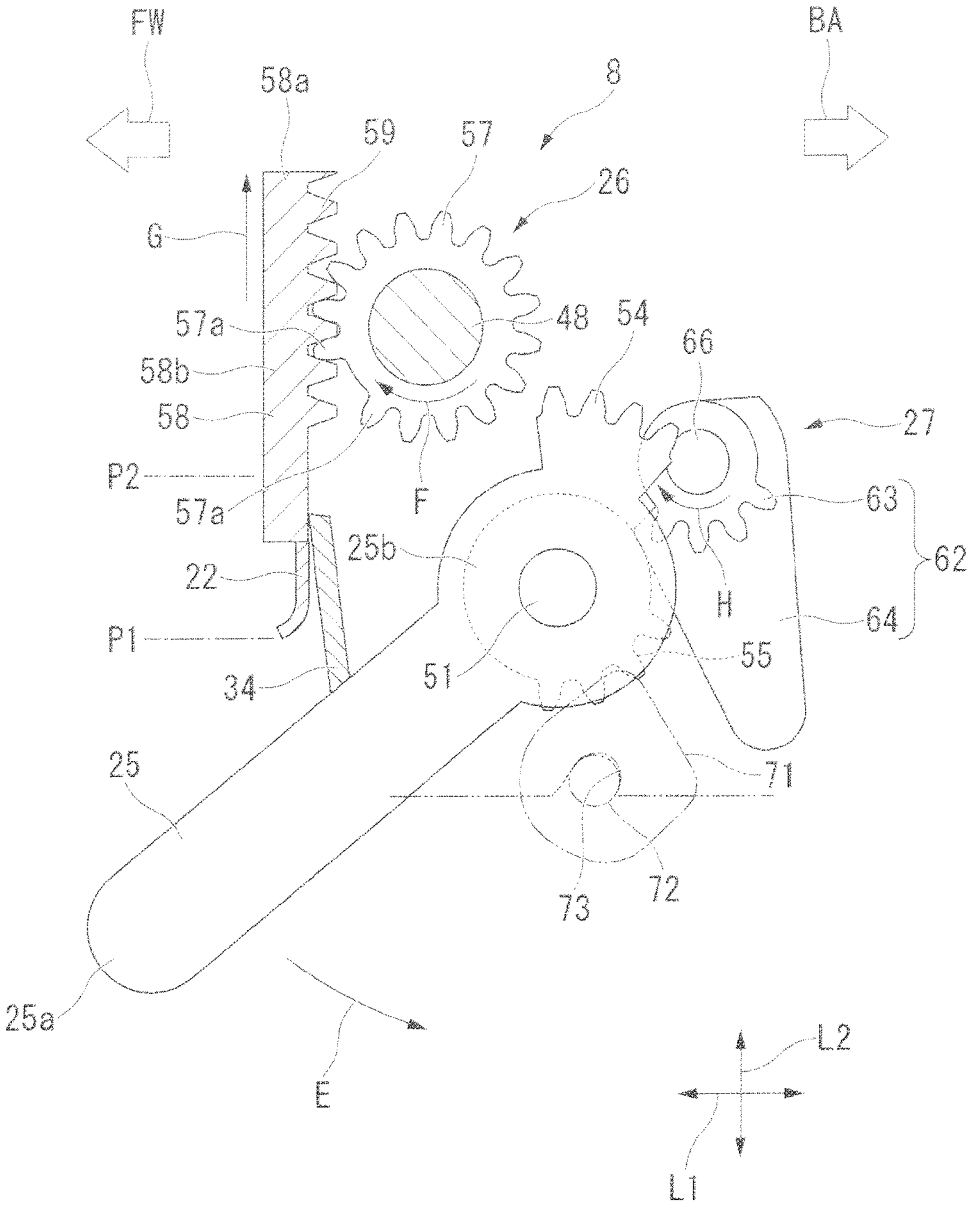
FIG. 6 is a sectional view for illustrating the printing unit in the first embodiment of the present invention taken along a line VI-VI of FIG. 3.

FIG. 6 is a sectional view taken along a line VI-VI of FIG. 3. As illustrated in FIG. 3 and FIG. 6, the return mechanism 26 is a mechanism configured to return the movable blade 22 from the cutting position P1 to the standby position P2. Specifically, the return mechanism 26 includes the first gear 54, a return pinion 57, and a return rack 58. The first gear 54 is formed at an upper end of the proximal end portion 25*b* of the unlocking lever 25. The return pinion 57 is arranged on an upper front side of the first gear 54. The return pinion 57 is rotatably supported by the pinion support shaft 48 and is arranged coaxially and adjacently to the drive pinion 45. Specifically, the return pinion 57 is arranged on a center side of the casing 2 (see FIG. 2) of the drive pinion 45 in the horizontal direction L3 along a side surface of the drive pinion 45. Further, the return pinion 57 is formed so as to be capable of meshing with the first gear 54.

The return rack 58 is arranged in front of the return pinion 57 so as to be capable of meshing with the return pinion 57. The return rack 58 is formed integrally with the drive rack 46 along a side surface thereof on a center side of the casing 2 (see FIG. 2) of the drive rack 46 in the horizontal direction L3. When the return rack 58 is formed integrally with the drive rack 46, the return rack 58 can be provided without increasing the number of parts. With this, the configuration of the printing unit 8 (that is, the thermal printer 1) is simplified, and further, cost is suppressed.

The return rack 58 is formed in the same manner as that of the drive rack 46 and is different from the drive rack 46 in number of teeth of the drive rack teeth 47. That is, the drive rack 46 has the drive rack teeth 47 formed in the entire region of the drive rack 46. Meanwhile, the return rack 58 has return rack teeth (rack teeth) 59 formed from an end portion (upper end portion) 58*a* on a side opposite to the blade edge 22*b* of the movable blade 22 to a region 58*b* in the vicinity of a center of the return rack 58. That is, the return rack 58 has the return rack teeth 59 formed only on the side opposite to the blade edge 22*b* of the movable blade 22. The return rack teeth 59 have the same tooth shapes as those of the drive rack teeth 47 of the drive rack 46 and are formed on the same extension line as that of the drive rack teeth 47.

Figure 8:
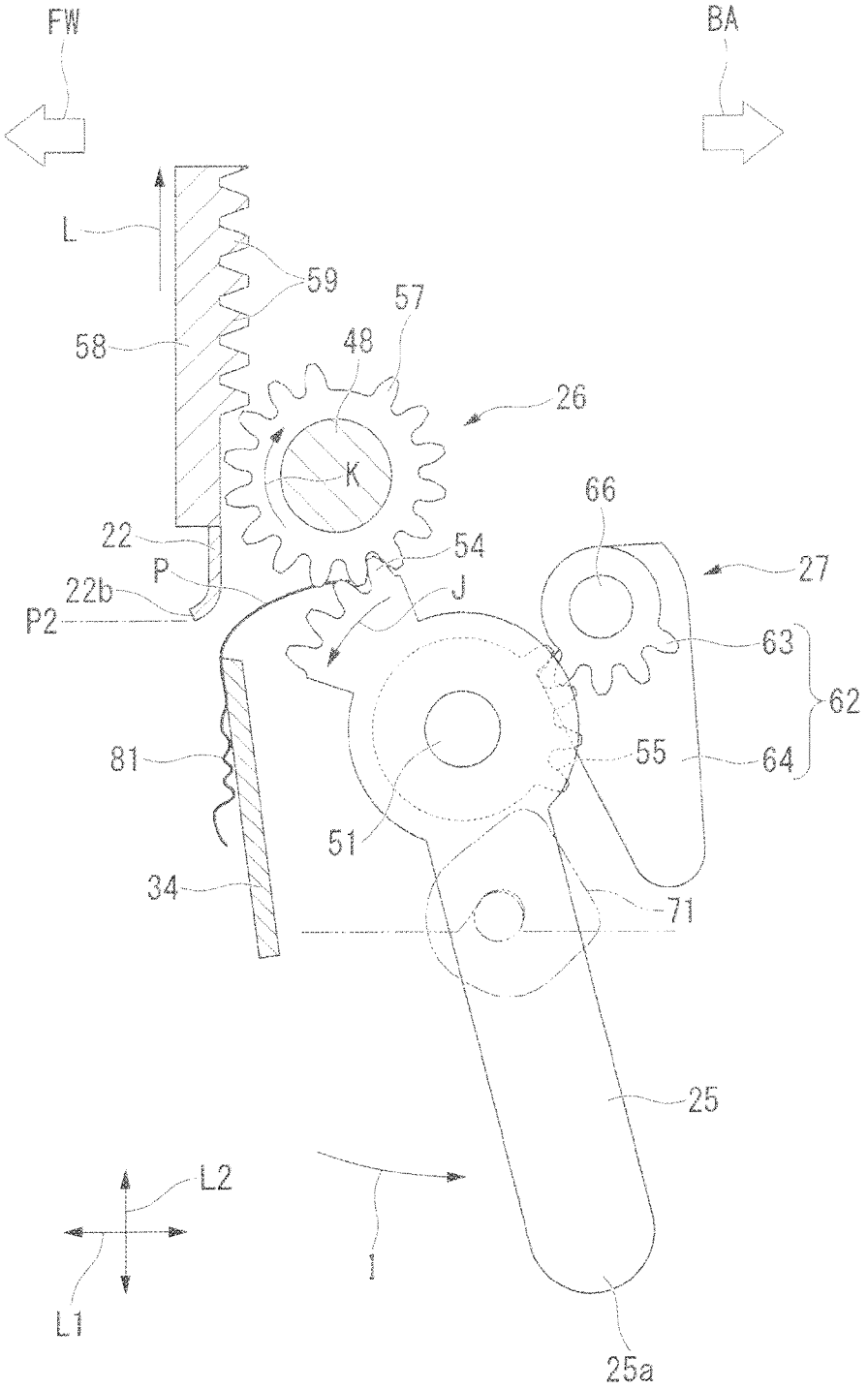
FIG. 8 is an explanatory view for illustrating an operation in which the movable blade of the printing unit in the first embodiment of the present invention is returned to a standby position.

When the return rack teeth 59 of the return rack 58 are formed only on the side opposite to the blade edge 22*b* of the movable blade 22, the meshing of the return pinion 57 with respect to the return rack teeth 59 of the return rack 58 is released under a state in which the return rack 58 is arranged at the standby position P2 (see FIG. 8). Meanwhile, the return rack teeth 59 of the return rack 58 are kept in a state of being meshed with the return pinion 57 under a state in which the return rack 58 is arranged at the cutting position P1.

With the return mechanism 26, when the unlocking lever 25 is pivoted in the direction of the arrow E, the first gear 54 is meshed with the return pinion 57. When the unlocking lever 25 is continuously pivoted in this state, the return pinion 57 rotates in a direction of an arrow F. When the return pinion 57 rotates, the return rack 58 moves in a direction of an arrow G together with the drive rack 46. The movable blade 22 moves in the direction of the arrow G together with the return rack 58. Thus, the movable blade 22 can be moved in the direction of the arrow G (that is, to the standby position P2) by being interlocked with the pivoting operation of the unlocking lever 25 in the direction of the arrow E.

In this case, from the return pinion 57, one tooth (pinion tooth 57*a*) between adjacent pinion teeth 57*a* is removed among a plurality of pinion teeth 57*a*. Thus, when one tooth between the adjacent pinion teeth 57*a* is removed, an interval between the adjacent pinion teeth 57*a* is kept large. As a result, when the pinion teeth 57*a* are meshed with the return rack teeth 59, abutment of a distal end of the pinion tooth 57*a* against a distal end of the return rack tooth 59 can be suppressed. With this, the pinion teeth 57*a* can be smoothly meshed with the return rack teeth 59. As another example, for example, the return pinion 57 having a configuration in which one tooth between the adjacent pinion teeth 57*a* is not removed may also be used.

Further, the return pinion 57 is rotatably supported by the pinion support shaft 48. Thus, when the movable blade 22 is at the standby position P2, even in the case where the unlocking lever 25 is operated, the motive power caused by the lever operation of the unlocking lever 25 is not transmitted to the movable blade drive mechanism 25 and the movable blade 22. With this, for example, when the unlocking lever 25 is operated under a state in which an error such as a paper jam does not occur, only unlocking of the platen unit 4 (see FIG. 2) can be implemented.

Further, the second gear 55 of the unlocking mechanism 27 is formed in the proximal end portion 25*b* of the unlocking lever 25. The unlocking mechanism 27 is a mechanism configured to release the locking of the printer cover 3 (see FIG. 1) by being interlocked with the pivoting operation of the unlocking lever 25. In other words, the locking of the platen unit 4 with respect to the head unit 5 is released by the unlocking lever 25. Specifically, the unlocking mechanism 27 includes the second gear 55 and a release plate 62. The release plate 62 is rotatably supported at the back of the second gear 55 on the side wall portion 23*a* side of the head frame 23 through intermediation of a plate support shaft 66. The release plate 62 includes a release gear 63 and a release cam 64.

The release gear 63 is formed so as to be capable of meshing with the second gear 55 of the unlocking lever 25. The release cam 64 is a cam that is formed integrally with the release gear 63 and is configured to release the combination between the head unit 5 and the platen unit 4 (see FIG. 2). The release cam 64 protrudes downwardly from the rotation center (that is, the plate support shaft 66) of the release plate 62.

With the unlocking mechanism 27, when the unlocking lever 25 is pivoted in the direction of the arrow E, the second gear 55 is meshed with the release gear 63. When the unlocking lever 25 is continuously pivoted in this state, the release gear 63 rotates in a direction of an arrow H. When the release gear 63 rotates, the release cam 64 swings in the direction of the arrow H together with the release gear 63. When the release cam 64 swings, the release cam 64 is engaged with a cam follower portion 71 on the platen unit 4 (see FIG. 2) side. When the release cam 64 is engaged with the cam follower portion 71, the cam follower portion 71 is pushed out in a direction in which a locking pin 72 is disengaged from a recess 73. When the locking pin 72 is disengaged from the recess 73, the combination between the platen unit 4 and the head unit 5 (see FIG. 2) is released.

In this case, when the locking of the printer cover 3 is released by operating the unlocking lever 25, the drive pinion 45 can be kept in a non-rotation state (suspension state). With this, the locking of the printer cover 3 can be released under a state in which the movable blade 22 is kept at the standby position P2.

Figure 7:
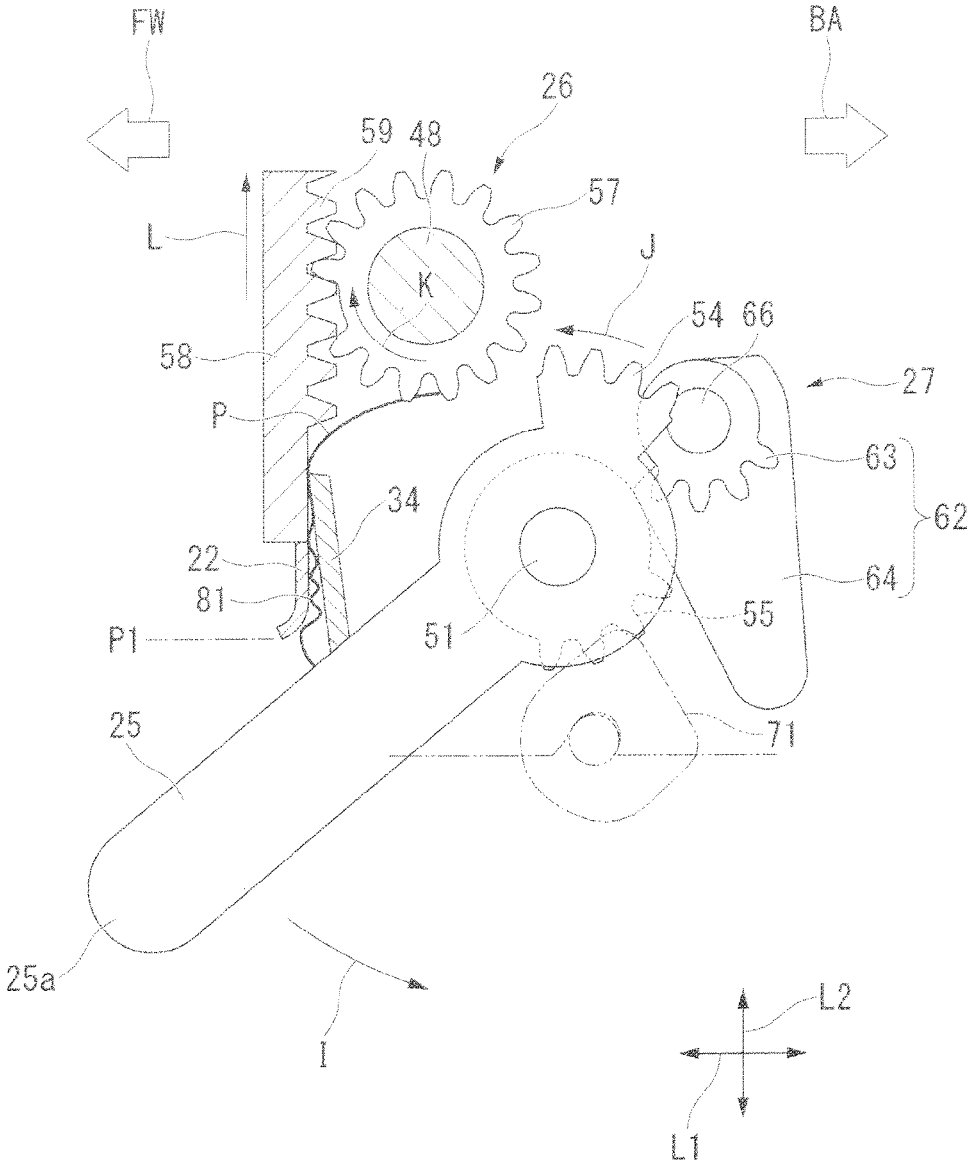
FIG. 7 is an explanatory view for illustrating an operation that may involve occurrence of a paper jam between the movable blade and the fixed blade of the printing unit in the first embodiment of the present invention.

Next, description is given of an example in which the movable blade 22 is returned to the standby position P2 by the return mechanism 26 when a paper jam 81 occurs between the movable blade 22 and the fixed blade 34 of the thermal printer 1 with reference to FIG. 7 and FIG. 8. In this case, the unlocking lever 25 configured to operate the return mechanism 26 is interlocked with the operation lever 13 (see FIG. 2). However, in FIG. 7 and FIG. 8, in order to facilitate understanding of the operation of the return mechanism 26, the operation of the return mechanism 26 is described based on the operation of the unlocking lever 25.

FIG. 7 is an explanatory view for illustrating an operation that may involve occurrence of the paper jam 81 between the movable blade 22 and the fixed blade 34. As illustrated in FIG. 7, the movable blade 22 is caused to slide to the cutting position P1 to cut the recording sheet P between the fixed blade 34 and the movable blade 22. In this state, it is conceivable that the paper jam 81 occurs between the movable blade 22 and the fixed blade 34. It is conceivable that the movable blade 22 stops at a position of riding on the fixed blade 34 due to the occurrence of the paper jam 81.

FIG. 8 is an explanatory view for illustrating an operation of returning the movable blade 22 to the standby position P2. When the movable blade 22 stops, the unlocking lever 25 is pivoted in a direction of an arrow I. The first gear 54 moves in a direction of an arrow J toward the return pinion 57 to be meshed with the return pinion 57. When the unlocking lever 25 is continuously pivoted in this state, the return pinion 57 is rotated by the first gear 54 in a direction of an arrow K. When the return pinion 57 rotates, the return rack 58 moves in a direction of an arrow L. When the return rack 58 moves, the movable blade 22 moves in the direction of the arrow L together with the return rack 58.

As illustrated in FIG. 8, through rotation of the return pinion 57, the movable blade 22 is moved in the direction of the arrow L to be returned to the standby position P2. Thus, the return pinion 57 is meshed with the return rack teeth 59 of the return rack 58. Further, the unlocking lever 25 can be interlocked with the return pinion 57. As a result, through the operation of the unlocking lever 25, the return rack 58 can be reliably returned to the standby position P2 by the return pinion 57. Here, the return rack 58 is formed integrally with the drive rack 46 (see FIG. 5). The drive rack 46 has the movable blade 22 mounted thereon. With this, through the operation of the unlocking lever 25, the movable blade 22 can be reliably returned to the standby position P2 by the return pinion 57 and the return rack 58.

The return rack 58 has the return rack teeth 59 only on the side opposite to the blade edge 22*b* of the movable blade 22. Thus, the return pinion 57 is disengaged from the return rack teeth 59 of the return rack 58 under a state in which the movable blade 22 is returned to the standby position P2. That is, the meshing of the return pinion 57 with respect to the return rack teeth 59 of the return rack 58 is released. As a result, when the locking of the printer cover 3 (see FIG. 1) is released after the movable blade 22 is returned to the standby position P2, the unlocking lever 25 can be operated without moving the return rack 58. With this, the locking of the printer cover 3 can be released under a state in which the movable blade 22 is kept at the standby position P2.

Figure 9:
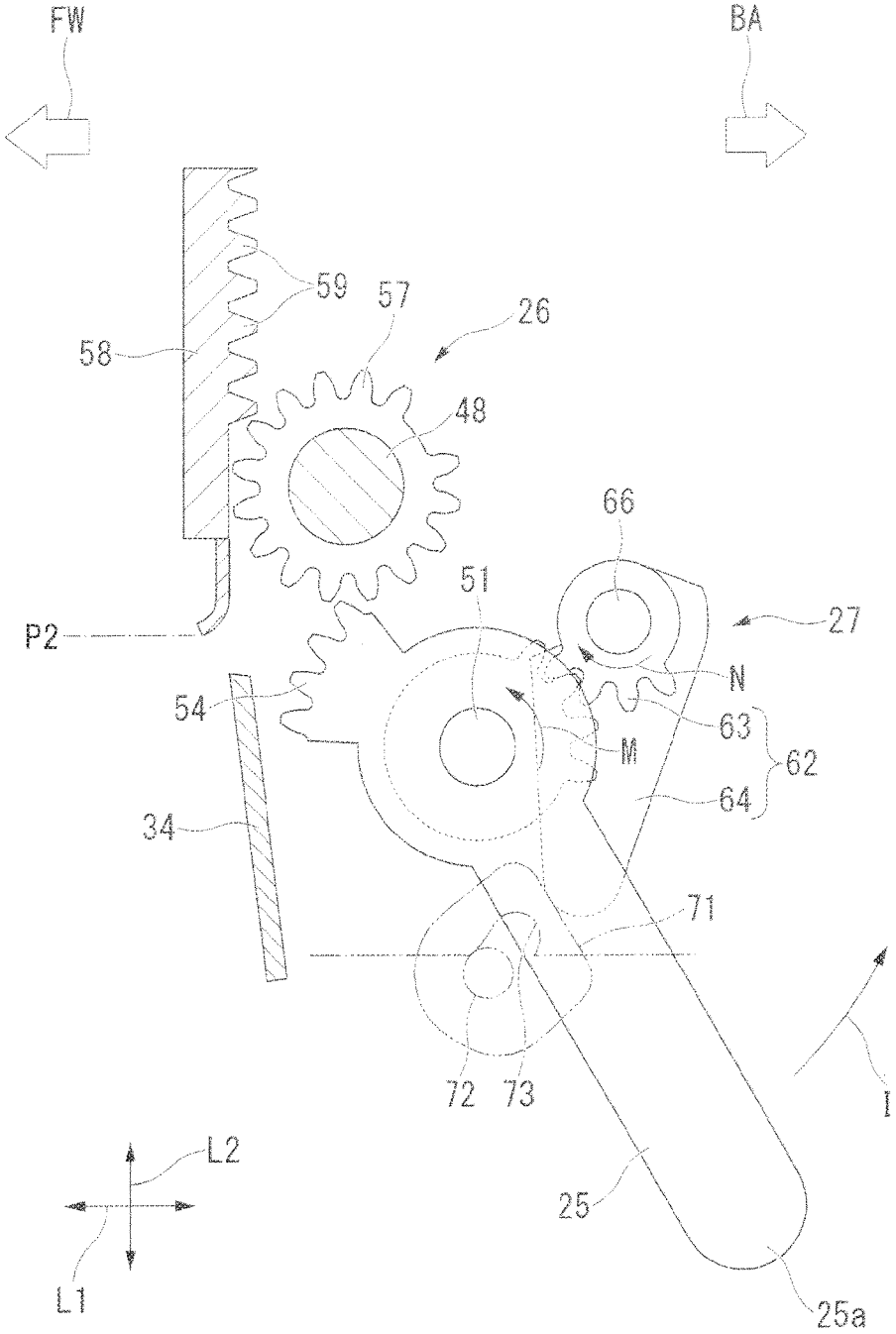
FIG. 9 is an explanatory view for illustrating an operation in which locking between a platen unit and a head unit of the thermal printer according to the first embodiment of the present invention is released.

Next, description is given of an example in which the locking of the printer cover 3 of the thermal printer 1 is released by the unlocking mechanism 27 with reference to FIG. 2 and FIG. 9. Also in FIG. 9, in order to facilitate understanding of the operation of the unlocking mechanism 27, the operation of the return mechanism 26 is described based on the operation of the unlocking lever 25. FIG. 9 is an explanatory view for illustrating an operation in which the locking between the platen unit 4 and the head unit 5 is released.

As illustrated in FIG. 9, the unlocking lever 25 is continuously pivoted in the direction of the arrow I under a state in which the movable blade 22 is returned to the standby position P2. When the unlocking lever 25 is pivoted, the second gear 55 moves in a direction of an arrow M to be meshed with the release gear 63. When the unlocking lever 25 is further continuously pivoted in this state, the release gear 63 rotates in a direction of an arrow N. When the release gear 63 rotates, the release cam 64 swings in the direction of the arrow N together with the release gear 63.

When the release cam 64 swings, the release cam 64 is engaged with the cam follower portion 71 on the platen unit 4 (see FIG. 2) side. When the release cam 64 is engaged with the cam follower portion 71, the cam follower portion 71 is pushed out in a direction in which the locking pin 72 is disengaged from the recess 73. When the locking pin 72 is disengaged from the recess 73, the locking in a combined state between the platen unit 4 and the head unit 5 (see FIG. 2) is released.

As illustrated in FIG. 2, the printer cover 3 is opened about the first pivot shaft 11 under a state in which the locking between the platen unit 4 and the head unit 5 is released. With this, the recording-sheet receiving portion 10 is opened, and the paper jam 81 (see FIG. 8) can be eliminated.

As described with reference to FIG. 2 and FIG. 7 to FIG. 9, before the locking of the printer cover 3 (specifically, the platen unit 4) is released, the unlocking lever 25 is interlocked with the return mechanism 26. Through the operation of the return mechanism 26 with the unlocking lever 25, the movable blade 22 can be reliably returned to the standby position P2 by the return mechanism 26. As described above, the thermal printer 1 is obtained, in which the paper jam 81 occurring between the fixed blade 34 and the movable blade 22 can be easily eliminated by reliably returning the movable blade 22 to the standby position P2. Further, the unlocking lever 25 configured to release the locking of the printer cover 3 can also be used as a lever for eliminating the paper jam 81 by interlocking the unlocking lever 25 configured to release the locking of the printer cover 3 with the return mechanism 26. With this, an increase in number of parts in the printing unit 8 (that is, the thermal printer 1) can be suppressed, and the configuration can be simplified.

In this case, the distal end portion 25*a* of the unlocking lever 25 is fitted on the inner side of the coupling member 16 of the operation lever 13. Thus, the unlocking lever 25 is operated by being interlocked with the pivoting operation of the operation lever 13. When the operation lever 13 is pivoted from the lock position to the release position, the unlocking lever 25 pivots backwardly by being interlocked with the operation lover 13. Thus, the return mechanism 26 and the unlocking mechanism 27 can be operated as described with reference to FIG. 7 to FIG. 9. With this, when the operation lever 13 is pivoted from the lock position to the release position, the paper jam 81 can be eliminated through the operation of the return mechanism 26 and the unlocking mechanism 27.

Next, a printing unit 100 in a second embodiment is described with reference to FIG. 10 and FIG. 11. In the printing unit 100 in the second embodiment, members that are the same as or similar to those of the printing unit 8 in the first embodiment are denoted by the same reference symbols, and detailed description thereof is omitted.

Figure 10:
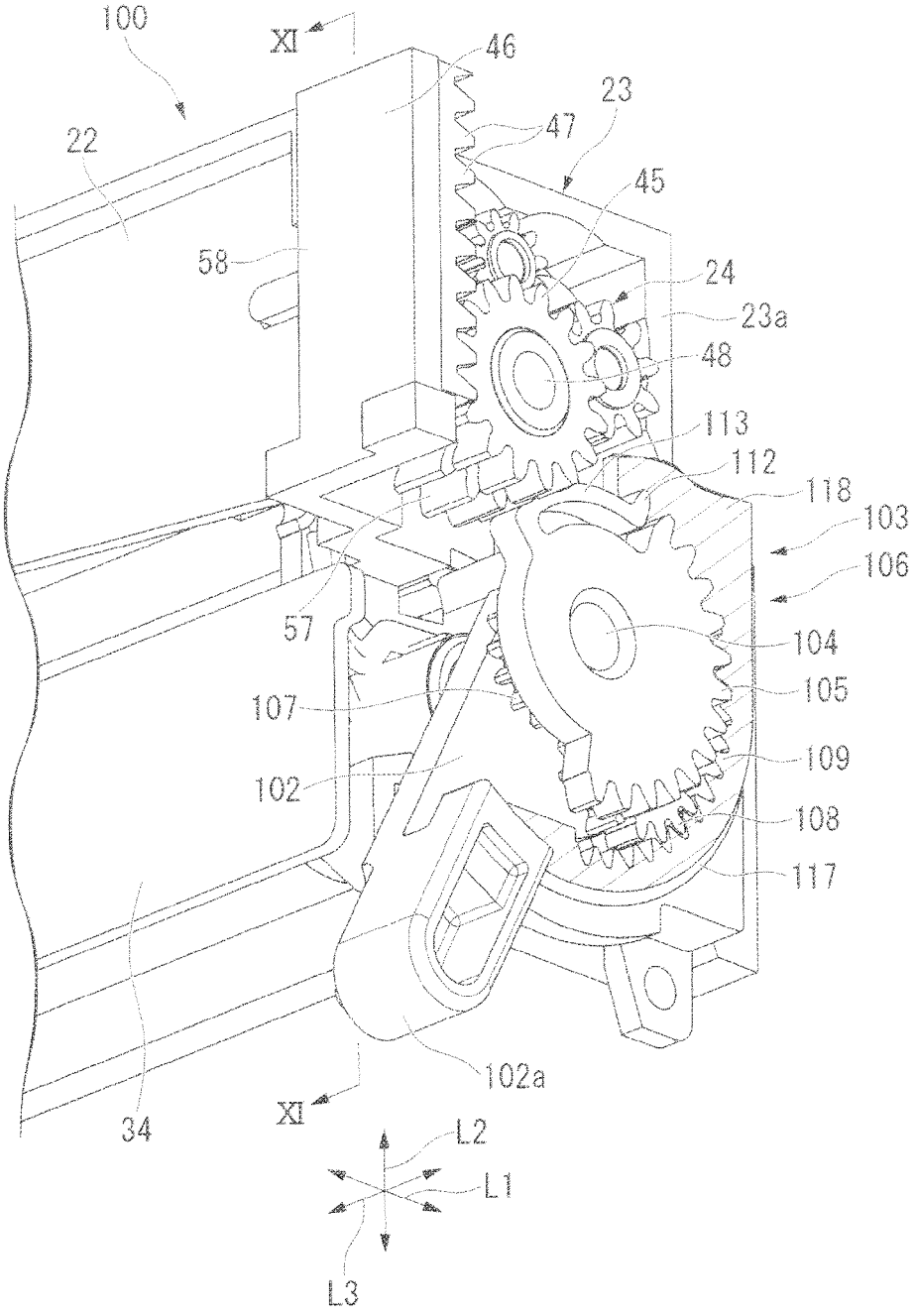
FIG. 10 is a perspective view of a printing unit of a thermal printer according to a second embodiment of the present invention when viewed from below.
Figure 11:
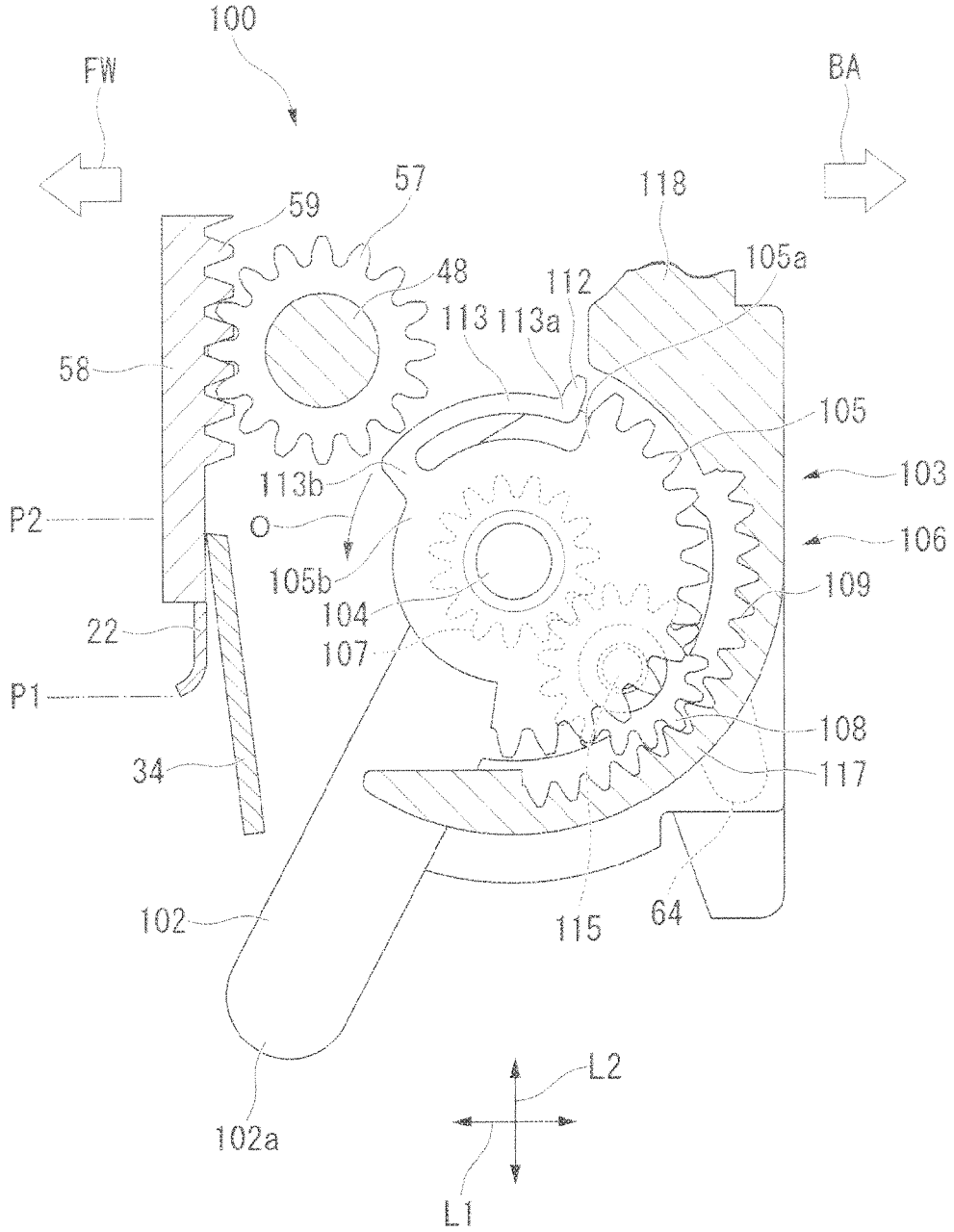
FIG. 11 is a sectional view for illustrating the printing unit in the second embodiment of the present invention taken along a line XI-XI of FIG. 10.

FIG. 10 is a perspective view of the printing unit 100 in the second embodiment when viewed from below. FIG. 11 is a sectional view taken along a line XI-XI of FIG. 10. As illustrated in FIG. 10 and FIG. 11, in the printing unit 100, the unlocking lever 25 in the first embodiment is replaced by an unlocking lever 102, and the return mechanism 26 in the first embodiment is replaced by a return mechanism 103. Other configurations of the printing unit 100 are the same as those of the printing unit 8 in the first embodiment.

The unlocking lever 102 has a lever support shaft 104 supported thereon coaxially with a rotation center of the unlocking lever 102. A first gear 105 and a sun gear 107 are rotatably supported coaxially through intermediation of the lever support shaft 104. The first gear 105 and the sun gear 107 are integrally formed. The first gear 105 and the sun gear 107 are members forming a part of the return mechanism 103.

The return mechanism 103 is a mechanism configured to return the movable blade 22 from the cutting position P1 to the standby position P2 in the same manner as in the return mechanism 26 in the first embodiment. Specifically, the return mechanism 103 includes the first gear 105, the return pinion 57, the return rack 58, and an acceleration mechanism 106.

The first gear 105 is rotatably supported through intermediation of the lever support shaft 104 of the unlocking lever 102. The lever support shaft 104 is supported coaxially with the rotation center of the unlocking lever 102. The first gear 105 includes a first tooth portion 112. The first tooth portion 112 is arranged on an arc of the first gear 105 on a side of an end portion 105*a* in a clockwise direction. In other words, the first tooth portion 112 forms a tooth portion at a most distal end of the first gear 105 in the clockwise direction. That is, when the first gear 105 rotates in a counterclockwise direction (arrow O), the first tooth portion 112 of the first gear 105 is first meshed with the return pinion 57. When the first gear 105 continuously rotates in the counterclockwise direction (arrow O) after the first tooth portion 112 is meshed with the return pinion 57, a portion of the first gear 105 behind the first tooth portion 112 is successively meshed with the return pinion 57.

In this case, the first tooth portion 112 of the first gear 105 is formed in a distal end portion 113*a* of an arm portion 113. A proximal end portion 113*b* of the arm portion 113 is coupled to a base portion 105*b* of the first gear 105. The base portion 105*b* is formed in an arc shape coaxially with the lever support shaft 104. The arm portion 113 is formed in a curved shape at a predetermined interval on a radially outer side with respect to the base portion 105*b*. The arm portion 113 is formed so as to be elastically deformable in a radial direction of the first gear 105 with the proximal end portion 113*b* being a fulcrum. Thus, when the arm portion 113 is elastically deformed toward the base portion 105*b*, the first tooth portion 112 can be retracted toward a radially inner side of the first gear 105. The reason that the first tooth portion 112 is formed so as to be retractable toward the radially inner side of the first gear 105 is described later in detail.

The first gear 105 is formed integrally with the sun gear 107 of the acceleration mechanism 106. The acceleration mechanism 106 includes the sun gear 107, a planetary gear 108, and an internal gear (internal teeth gear) 109. The sun gear 107 is provided coaxially with the first gear 105. The sun gear 107 is formed integrally with an inner surface of the first gear 105. The planetary gear 108 is arranged so as to be meshed with the sun gear 107. The planetary gear 108 is rotatably supported by the unlocking lever 102 through intermediation of a planetary shaft 115. The planetary shaft 115 is provided at a position displaced from the lever support shaft 104. Thus, when the unlocking lever 102 rotates about the lever support shaft 104, the planetary shaft 115 (that is, the planetary gear 108) revolves about the lever support shaft 104 following the movement of the unlocking lever 102.

The planetary gear 108 is meshed with the internal gear 109. The internal gear 109 is formed in an arc shape on an inner periphery of a cover curved portion 117. The cover curved portion 117 is formed integrally with a side cover 118 configured to cover a side portion of the printing unit 100.

In the return mechanism 103, when the unlocking lever 102 rotates in an operation direction about the lever support shaft 104, the planetary shaft 115 (that is, the planetary gear 108) revolves about the lever support shaft 104 following the movement of the unlocking lever 102. When the planetary gear 108 revolves, the planetary gear 108 rotates (rotates on an axis thereof) in the clockwise direction while being meshed with the internal gear 109. Thus, the sun gear 107 rotates in the counterclockwise direction. The first gear 105 rotates in the counterclockwise direction together with the sun gear 107.

When the sun gear 107 is rotated in the counterclockwise direction by the planetary gear 108, the first gear 105 rotates in the counterclockwise direction (arrow O) together with the sun gear 107. Thus, the rotation amount of the first gear 105 can be ensured to be large with respect to the stroke amount of the unlocking lever 102. As described above, the first gear 105 is supported so as to be individually rotatable with respect to the unlocking lever 102. Further, when the sun gear 107 of the acceleration mechanism 106 is formed integrally with the first gear 105, the rotation amount of the first gear 105 can be ensured to be large under a state in which the stroke amount of the unlocking lever 102 is suppressed to be small. With this, when the movable blade 22 is returned to the standby position P2, the operability of the unlocking lever 102 can be satisfactorily ensured.

Next, description is given of an example in which the movable blade 22 is returned to the standby position P2 by the return mechanism 103 when the paper jam 81 occurs between the movable blade 22 and the fixed blade 34 of the printing unit 100 with reference to FIG. 12 to FIG. 16. In this case, the unlocking lever 102 configured to operate the return mechanism 103 is interlocked with the operation lever 13 (see FIG. 2). However, in FIG. 12 to FIG. 16, in order to facilitate understanding of the operation of the return mechanism 103, the operation of the return mechanism 103 is described based on the operation of the unlocking lever 102.

Figure 12:
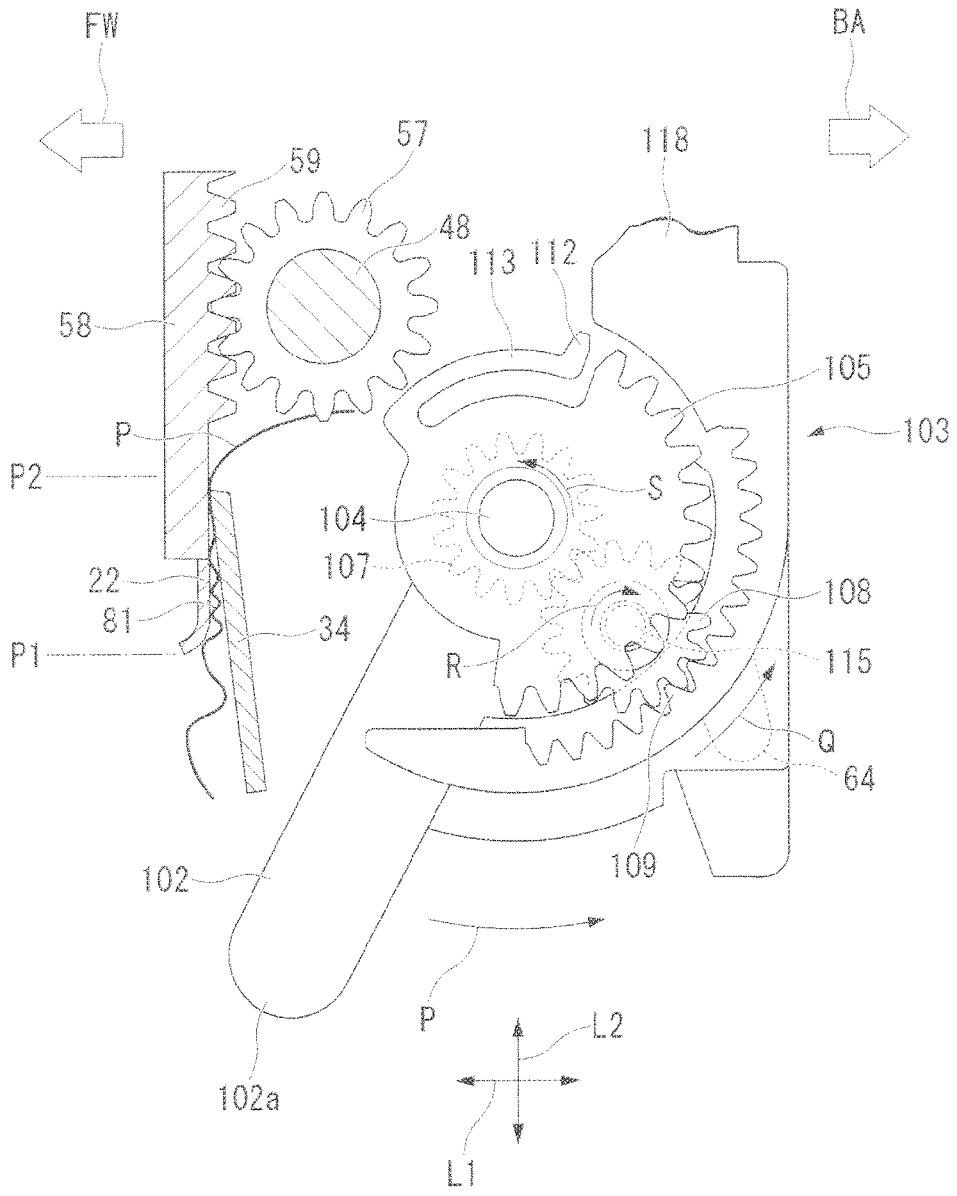
FIG. 12 is an explanatory view for illustrating an operation that may involve occurrence of a paper jam between a movable blade and a fixed blade of the printing unit in the second embodiment of the present invention.

FIG. 12 is an explanatory view for illustrating an operation that may involve occurrence of the paper jam 81 between the movable blade 22 and the fixed blade 34. As illustrated in FIG. 12, the movable blade 22 is caused to slide to the cutting position P1 to cut the recording sheet P between the fixed blade 34 and the movable blade 22. In this state, it is conceivable that the paper jam 81 occurs between the movable blade 22 and the fixed blade 34. It is conceivable that the movable blade 22 stops at a position of riding on the fixed blade 34 due to the occurrence of the paper jam 81.

When the movable blade 22 stops, the unlocking lever 102 is pivoted in a direction of an arrow P. The planetary gear 108 revolves in a direction of an arrow Q about the lever support shaft 104 and rotates on an axis thereof in a direction of an arrow R about the planetary shaft 115. Thus, the sun gear 107 rotates in a direction of an arrow S. When the sun gear 107 rotates, the first gear 105 rotates in the direction of the arrow S together with the sun gear 107.

Figure 13:
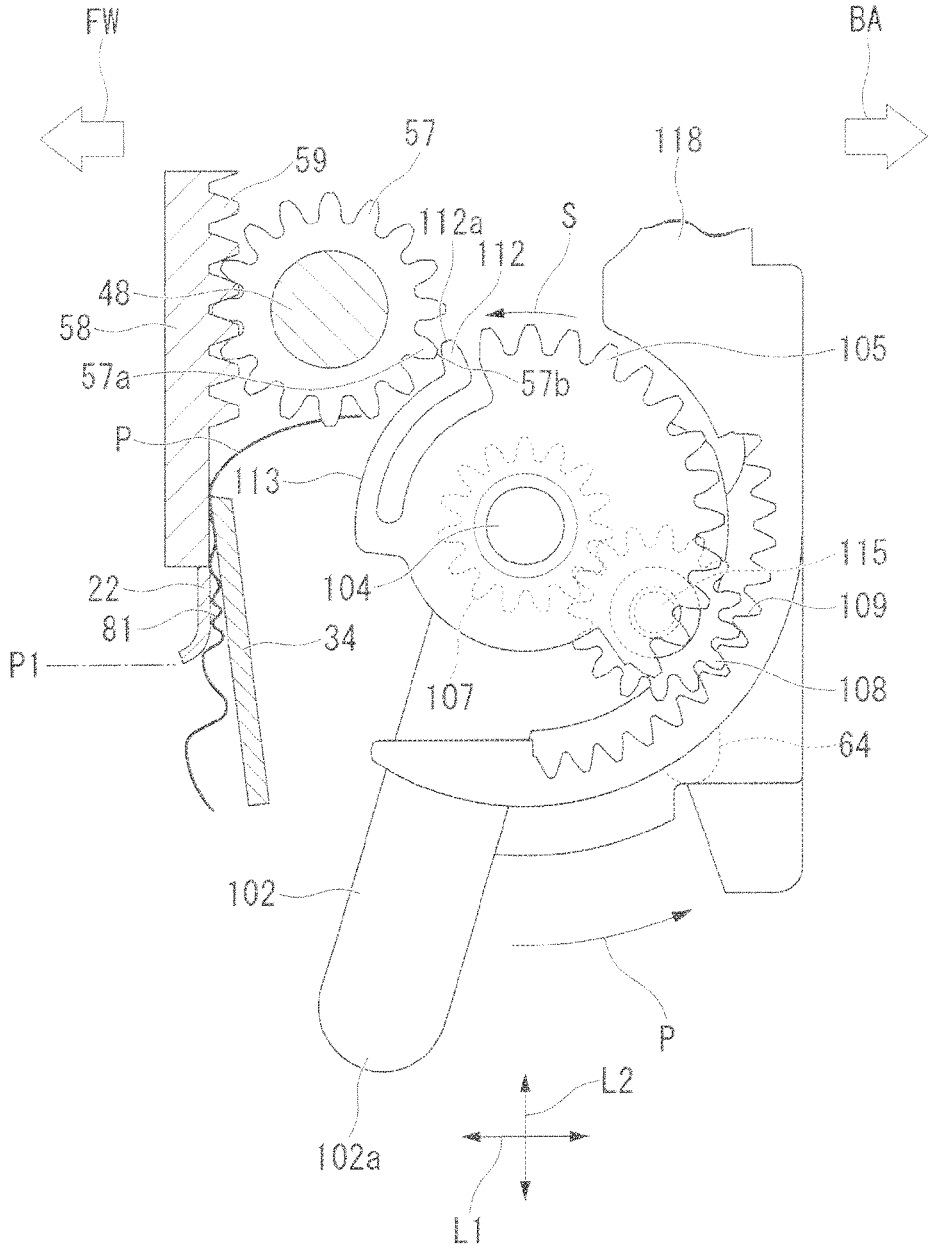
FIG. 13 is an explanatory view for illustrating an operation in which a first tooth portion of a first gear is meshed with a return pinion in the second embodiment of the present invention.

FIG. 13 is an explanatory view for illustrating an operation in which the first tooth portion 112 of the first gear 105 is meshed with the return pinion 57. As illustrated in FIG. 13, the first gear 105 moves in the direction of the arrow S toward the return pinion 57 to be meshed with the return pinion 57. When the first gear 105 is meshed with the return pinion 57, the first tooth portion 112 of the first gear 105 is first meshed with the return pinion 57. In this case, the return pinion 57 is rotatably supported by the pinion support shaft 48. Thus, it is conceivable that, when the first tooth portion 112 of the first gear 105 is meshed with the return pinion 57, a blade edge 57*b* of a pinion tooth 57*a* of the return pinion 57 is arranged at a position of being brought into abutment against a blade edge 112*a* of the first tooth portion 112.

Figure 14:
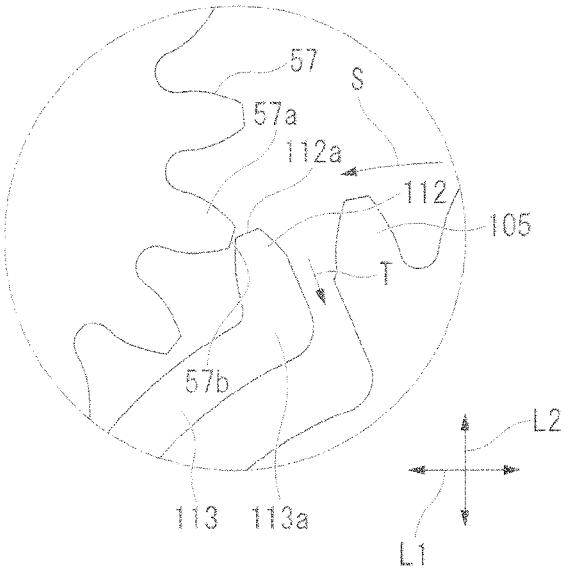
FIG. 14 is an explanatory view for illustrating an operation in which the first tooth portion of the first gear rides over a blade edge of the return pinion in the second embodiment of the present invention.

FIG. 14 is an explanatory view for illustrating an operation in which the first tooth portion 112 of the first gear 105 rides over the blade edge 57*b* of the return pinion 57. As illustrated in FIG. 14, when the blade edge 112*a* of the first tooth portion 112 is brought into abutment against the blade edge 57*b* of the return pinion 57, there is a risk in that the rotation of the first gear 105 may be inhibited by the return pinion 57. In view of the foregoing, the first tooth portion 112 of the first gear 105 is formed in the distal end portion 113*a* of the arm portion 113. Thus, the first tooth portion 112 can be retracted in a direction of an arrow T toward the radially inner side of the first gear 105 by elastically deforming the arm portion 113. In this state, the first gear 105 rotates in the counterclockwise direction as indicated by the arrow S, and the first tooth portion 112 rides over the blade edge 57*b* of the pinion tooth 57*a* of the return pinion 57.

Figure 15:
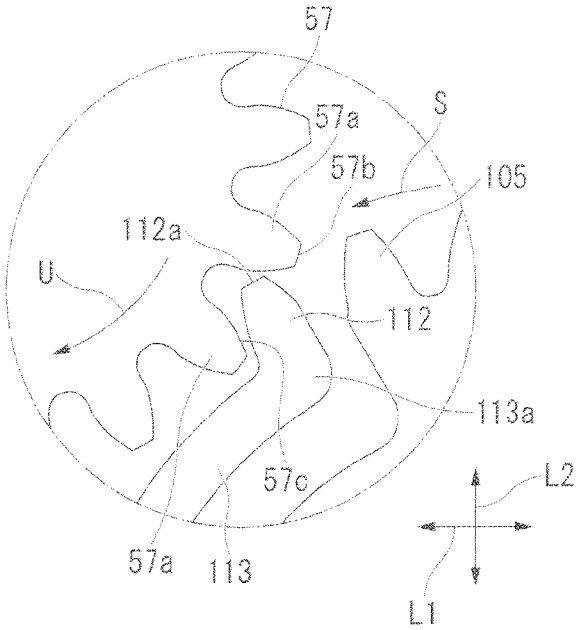
FIG. 15 is an explanatory view for illustrating an operation in which the first tooth portion having ridden over the blade edge of a pinion tooth of the return pinion is brought into abutment against a side surface of a subsequent pinion tooth in the second embodiment of the present invention.

FIG. 15 is an explanatory view for illustrating an operation in which the first tooth portion 112 having ridden over the blade edge 57*b* of the pinion tooth 57*a* of the return pinion 57 is brought into abutment against a side surface 57*c* of a subsequent pinion tooth 57*a*. As illustrated in FIG. 15, after the first tooth portion 112 rides over the blade edge 57*b* of the pinion tooth 57*a* of the return pinion 57, the first tooth portion 112 is returned from the retracted position to an original position with a restoring force of the arm portion 113. The returned first tooth portion 112 is brought into abutment against the side surface (tooth surface) 57*c* of the subsequent pinion tooth 57*a*.

The "subsequent pinion tooth 57*a*" refers to a pinion tooth 57*a* adjacent to the pinion tooth 57*a*, which the first tooth portion 112 has ridden over, in a rotation direction (that is, the direction of the arrow S) of the first tooth portion 112. In other words, the "subsequent pinion tooth 57*a*" refers to a pinion tooth 57*a* which the first tooth portion 112 rotating in the direction of the arrow S is first brought into abutment against after riding over the pinion tooth 57*a*. When the returned first tooth portion 112 is brought into abutment against the side surface 57*c* of the subsequent pinion tooth 57*a*, the return pinion 57 can be rotated in a direction of an arrow U by the first tooth portion 112 (that is, the first gear 105).

Figure 16:
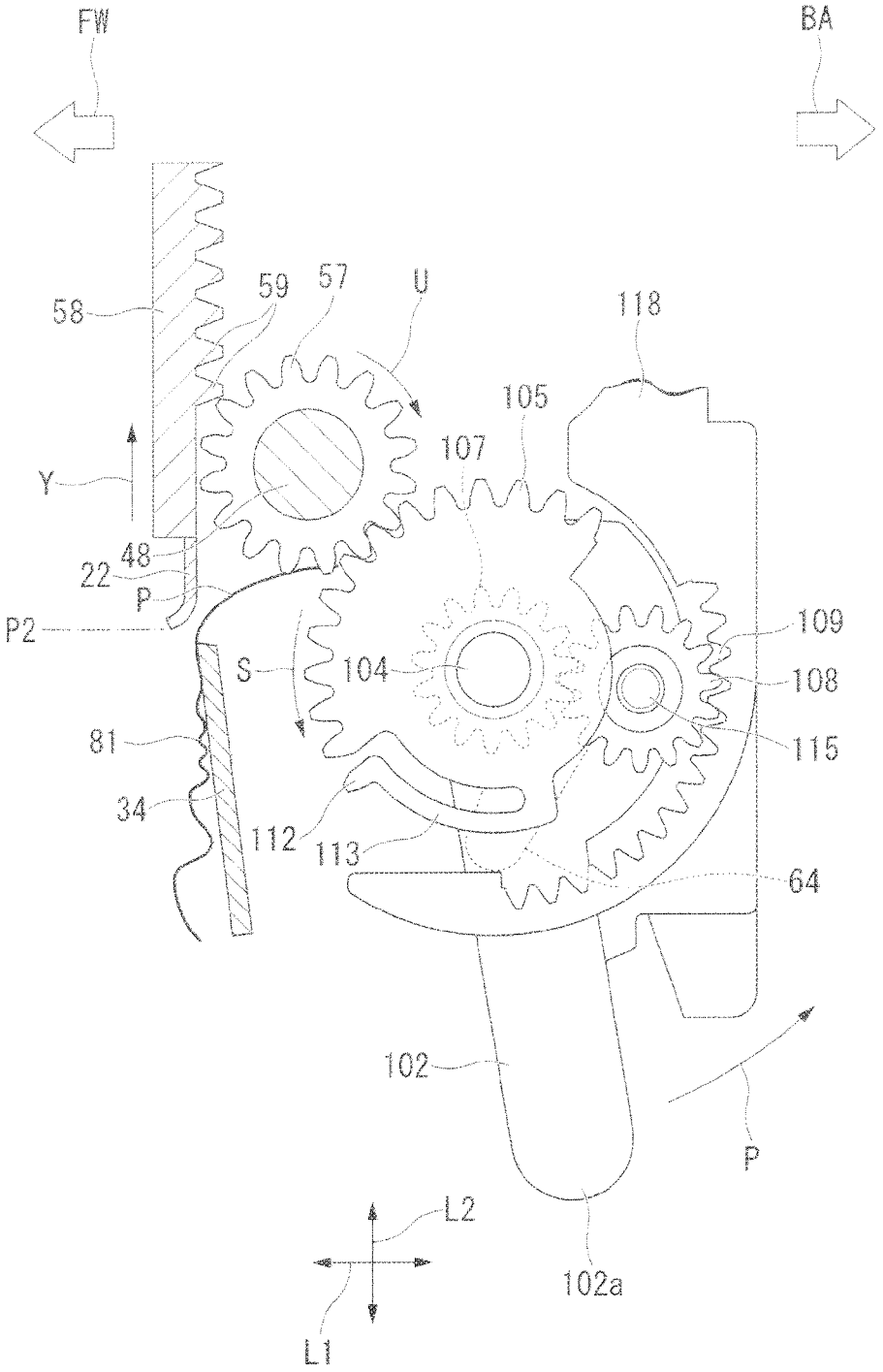
FIG. 16 is an explanatory view for illustrating an operation in which the movable blade of the printing unit is returned to a standby position in the second embodiment of the present invention.

FIG. 16 is an explanatory view for illustrating an operation of returning the movable blade 22 to the standby position P2. As illustrated in FIG. 16, when the unlocking lever 102 is continuously pivoted in the direction of the arrow P, the return pinion 57 is continuously rotated in the direction of the arrow U by the first gear 105. When the return pinion 57 rotates, the return rack 58 moves in a direction of an arrow Y in the same manner as in the first embodiment. When the return rack 58 moves, the movable blade 22 moves in the direction of the arrow Y together with the return rack 58 to be returned to the standby position P2.

In this case, the sun gear 107 of the acceleration mechanism 106 is formed integrally with the first gear 105. Thus, the rotation amount of the first gear 105 required for returning the movable blade 22 to the standby position P2 can be ensured under a state in which the stroke amount of the unlocking lever 102 is suppressed to be small. With this, the operability of the unlocking lever 102 can be satisfactorily ensured.

The return rack 58 has the return rack teeth 59 formed only on the side opposite to the blade edge 22*b* of the movable blade 22. Thus, the return pinion 57 is disengaged from the return rack teeth 59 of the return rack 58 under a state in which the movable blade 22 is returned to the standby position P2. That is, in the same manner as in the first embodiment, the meshing of the return pinion 57 with respect to the return rack teeth 59 of the return rack 58 is released. Thus, when the locking of the printer cover 3 (see FIG. 1) is released after the movable blade 22 is returned to the standby position P2, the unlocking lever 102 can be operated without moving the return rack 58. With this, the locking of the printer cover 3 can be released under a state in which the movable blade 22 is kept at the standby position P2.

Figure 17:
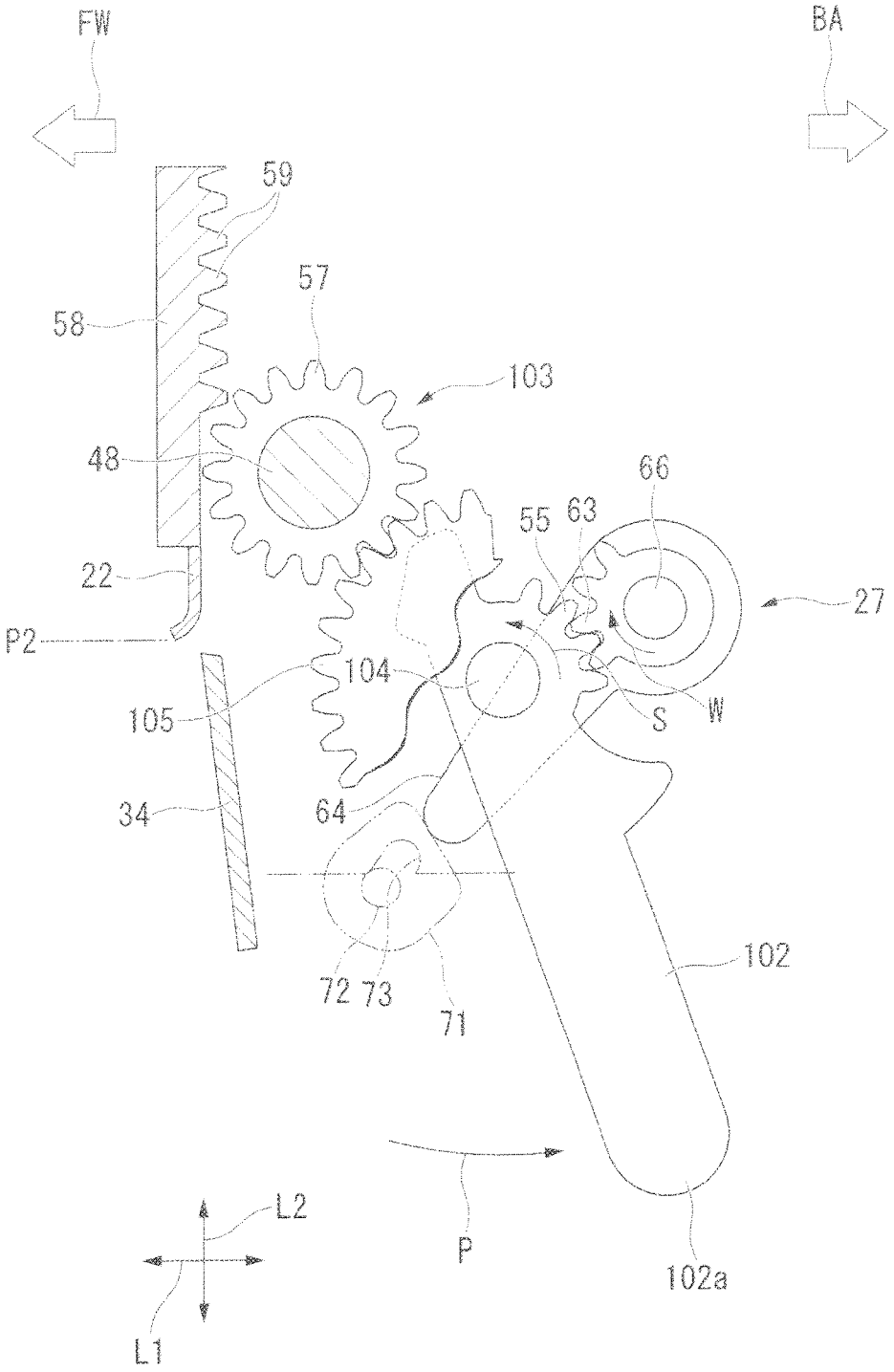
FIG. 17 is an explanatory view for illustrating an operation in which locking between a platen unit and a head unit of the thermal printer according to the second embodiment of the present invention is released.

Next, description is given of an example in which the locking of the printer cover 3 of the thermal printer 1 is released by the unlocking mechanism 27 with reference to FIG. 2 and FIG. 17. Also in FIG. 17, in order to facilitate understanding of the operation of the unlocking mechanism 27, the operation of the return mechanism 103 is described based on the operation of the unlocking lever 102. FIG. 17 is an explanatory view for illustrating an operation in which the locking between the platen unit and the head unit is released.

As illustrated in FIG. 17, the unlocking lever 102 is continuously pivoted in the direction of the arrow P under a state in which the movable blade 22 is returned to the standby position P2. When the unlocking lever 102 is pivoted, the second gear 55 moves in the direction of the arrow S to be meshed with the release gear 63. When the unlocking lever 102 is further continuously pivoted in the direction of the arrow P in this state, the release gear 63 rotates in a direction of an arrow W. When the release gear 63 rotates, the release cam 64 swings in the direction of the arrow W together with the release gear 63.

When the release cam 64 swings, the release cam 64 is engaged with the cam follower portion 71 on the platen unit 4 (see FIG. 2) side. When the release cam 64 is engaged with the cam follower portion 71, the cam follower portion 71 is pushed out in the direction in which the locking pin 72 is disengaged from the recess 73. When the locking pin 72 is disengaged from the recess 73, the locking between the platen unit 4 and the head unit 5 (see FIG. 2) in a combined state is released.

As illustrated in FIG. 2, the printer cover 3 is opened about the first pivot shaft 11 under a state in which the locking between the platen unit 4 and the head unit 5 is released. With this, the recording-sheet receiving portion 10 is opened, and the paper jam 81 (see FIG. 16) can be eliminated.

As described with reference to FIG. 2 and FIG. 12 to FIG. 17, before the locking of the printer cover 3 (specifically, the platen unit 4) is released, the unlocking lever 102 is interlocked with the return mechanism 103. Through the operation of the return mechanism 103 with the unlocking lever 102, the movable blade 22 can be reliably returned to the standby position P2 by the return mechanism 103. As described above, the thermal printer 1 is obtained, in which the paper jam 81 occurring between the fixed blade 34 and the movable blade 22 can be easily eliminated by reliably returning the movable blade 22 to the standby position P2. Further, the unlocking lever 102 configured to release the locking of the printer cover 3 can also be used as a lever configured to eliminate the paper jam 81 by interlocking the unlocking lever 102 configured to release the locking of the printer cover 3 with the return mechanism 103. With this, an increase in number of parts in the printing unit 8 (that is, the thermal printer 1) can be suppressed, and the configuration can be simplified.

In this case, a distal end portion 102*a* of the unlocking lever 102 is fitted on the inner side of the coupling member 16 of the operation lever 13. Thus, the unlocking lever 102 is operated by being interlocked with the pivoting operation of the operation lever 13. When the operation lever 13 is pivoted from the lock position to the release position, the unlocking lever 102 pivots backwardly by being interlocked with the operation lover 13. Thus, the return mechanism 103 and the unlocking mechanism 27 can be operated as described with reference to FIG. 12 to FIG. 17. With this, when the operation lever 13 is pivoted from the lock position to the release position, the paper jam 81 can be eliminated through the operation of the return mechanism 103 and the unlocking mechanism 27.

The technical range of the present invention is not limited to the above-mentioned embodiment and can be variously modified within a scope not departing from the spirit of the present invention. For example, in the above-mentioned embodiment, description is given of the example in which the fixed blade 34 is provided on the printer cover 3 (specifically, the platen unit 4), and the movable blade 22 is provided on the casing 2 (specifically, the head unit 5), but the present invention is not limited thereto. As another example, for example, the fixed blade 34 may be provided on the casing 2, and the movable blade 22 may be provided on the printer cover 3.

Further, in the above-mentioned embodiment, description is given of the example in which the fixed blade 34 is kept in a fixed state, and the movable blade 22 is returned to the standby position P2 by the unlocking lever 25, to thereby eliminate the paper jam 81, but the present invention is not limited thereto. As another example, for example, when the movable blade 22 is returned to the standby position P2 by the unlocking lever 25, the fixed blade 34 may also be lowered in a direction of being separated from the movable blade 22. In this case, the operation of separating the fixed blade 34 from the movable blade 22 is also designed so as to be operated by the unlocking lever 25.

Further, in the above-mentioned embodiment, description is given of the example in which the unlocking lever 25 is interlocked with the pivoting operation of the operation lever 13, but the present invention is not limited thereto. As another example, for example, the distal end portion 25*a* of the unlocking lever 25 may also be exposed to the outside of the casing 2 so that a user can directly operate the unlocking lever 25 from the outside of the casing 2.

Further, in the above-mentioned first and second embodiment, description is given of the example in which the return rack 58 is formed integrally with the drive rack 46, but the present invention is not limited thereto. As another example, for example, the return rack 58 may also be provided individually as a member separate from the drive rack 46. In this case, it is required to mount the return rack 58 on the movable blade 22.

Further, in the above-mentioned first embodiment and second embodiment, description is given of the example in which the return rack 58 is arranged on an inner side of the drive rack 46, but the present invention is not limited thereto. As another example, the return rack 58 may also be arranged on an outer side of the drive rack 46.

Further, in the above-mentioned second embodiment, description is given of the example in which the acceleration mechanism 106 includes the sun gear 107, the planetary gear 108, and the internal gear 109, but the present invention is not limited thereto. The acceleration mechanism 106 can also have another configuration.

What is claimed is:

1. A printing unit, comprising:

a head unit including a thermal head configured to perform printing on a recording sheet;

a platen unit including a platen roller configured to convey the recording sheet and is separably combined with the head unit;

a fixed blade provided to any one of the head unit and the platen unit;

a movable blade, which is to be provided to another one of the head unit and the platen unit, and is configured to slide with respect to the fixed blade;

a drive mechanism configured to cause the movable blade to slide between a standby position of being separated from the fixed blade and a cutting position of riding on the fixed blade;

an unlocking lever configured to release locking of the platen unit with respect to the head unit; and a return mechanism configured to move the movable blade to the standby position before releasing the locking of the platen unit by being interlocked with the unlocking lever under a state in which the movable blade is held at the cutting position, wherein the return mechanism comprises a return rack formed on a drive rack of the drive mechanism, and a return pinion configured to mesh with rack teeth of the return rack and be rotated by rotational power of the unlocking lever.

2. The printing unit according to claim 1, wherein the return mechanism comprises:

a first gear and a sun gear, which are rotatably supported coaxially with a rotation center of the unlocking lever;

a planetary gear, which is rotatably supported so as to be meshed with the sun gear, and is configured to revolve following movement of the unlocking lever; and an internal gear configured to be meshed with the planetary gear, and wherein the first gear is formed so as to be capable of meshing with the return pinion.

3. The printing unit according to claim 2, wherein the return rack comprises rack teeth, which are formed on a side opposite to a blade edge of the movable blade so that the rack teeth are meshed with the return pinion under a state in which the return rack is arranged at the cutting position and so that the meshing of the rack teeth with respect to the return pinion is released under a state in which the return rack is arranged at the standby position.

4. The printing unit according to claim 3, wherein the return pinion is rotatably provided to a support shaft of a drive pinion of the drive mechanism, the support shaft being configured to mesh with the drive rack.

5. The printing unit according to claim 4, wherein one tooth of the pinion teeth is removed from the return pinion.

6. The printing unit according to claim 2, wherein the first gear comprises a first tooth portion, which is capable of first meshing with the return pinion, and is retractable toward a radially inner side.

7. The printing unit according to claim 1, wherein the return pinion is rotatably provided to a support shaft of a drive pinion of the drive mechanism, the support shaft being configured to mesh with the drive rack.

8. The printing unit according to claim 1, wherein one tooth of the pinion teeth is removed from the return pinion.

9. A thermal printer, comprising the printing unit of claim 1, wherein the movable blade is provided to a printer main body including a recording-sheet receiving portion configured to receive the recording sheet, and wherein the fixed blade is provided to a printer cover, which is pivotably coupled to the printer main body, and is configured to open and close the recording-sheet receiving portion.

* * * * *